US008102105B2

(12) United States Patent
Ban et al.

(10) Patent No.: US 8,102,105 B2
(45) Date of Patent: Jan. 24, 2012

(54) SPARK PLUG

(75) Inventors: Kenji Ban, Gifu (JP); Jiro Kyuno, Aichi (JP); Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 376 days.

(21) Appl. No.: 12/548,504

(22) Filed: Aug. 27, 2009

(65) Prior Publication Data

US 2010/0096968 A1 Apr. 22, 2010

(30) Foreign Application Priority Data

Sep. 2, 2008 (JP) ..... 2008-224877
Aug. 25, 2009 (JP) ..... 2009-194021

(51) Int. Cl.
*H01T 13/20* (2006.01)

(52) U.S. Cl. ..... 313/141; 313/118

(58) Field of Classification Search ..... 313/118, 313/141; 123/169 EL
See application file for complete search history.

(56) References Cited

U.S. PATENT DOCUMENTS 5,210,457 A * 5/1993 Oshima et al. ..... 313/11.5
6,121,719 A * 9/2000 Matsutani et al. ..... 313/141
6,523,515 B2 * 2/2003 Kanao ..... 123/169 EL
6,710,523 B2 * 3/2004 Segawa et al. ..... 313/141
6,759,795 B2 * 7/2004 Kumagai et al. ..... 313/141
7,781,949 B2 * 8/2010 Kishimoto et al. ..... 313/141
2001/0025617 A1 * 10/2001 Kanao ..... 123/169 EL
2005/0179353 A1 * 8/2005 Watanabe ..... 313/141
2007/0216275 A1 9/2007 Torii et al. ..... 313/141
2008/0122334 A1 * 5/2008 Kishimoto et al. ..... 313/141
2009/0289540 A1 * 11/2009 Nunome et al. ..... 313/141
2011/0012498 A1 * 1/2011 Ma et al. ..... 313/141

FOREIGN PATENT DOCUMENTS

JP 11-185928 A 7/1999
JP 2007287667 11/2007
WO WO 2009037884 A1 * 3/2009

OTHER PUBLICATIONS

Notification of Reasons for Refusal (dated Jul. 20, 2010) issued in connection with corresponding Japanese Patent Application No. 2009-194021, with English translation.

* cited by examiner

*Primary Examiner* — Nimeshkumar D. Patel
*Assistant Examiner* — Glenn Zimmerman
(74) *Attorney, Agent, or Firm* — Kusner & Jaffe

(57) ABSTRACT

A spark plug in which the rising of a ground electrode is more reliably restrained. The spark plug includes a ground electrode having a core portion extending from a proximal end section toward a distal end section via a bent section, a heat transfer portion extending from the proximal end section toward the distal end section via the bent section, and an external layer located externally of the core portion and the heat transfer portion and extending from the proximal end section to the distal end section via the bent section. As viewed on a section of the ground electrode taken orthogonally to a direction along which the ground electrode extends, at least at an intermediate position of the bent section with respect to the direction, the center of the core portion is offset toward a center electrode from the center of the heat transfer portion.

9 Claims, 13 Drawing Sheets

| EXTERNAL LAYER (INCONEL 601) | INTERMEDIATE LAYER (COPPER) | CORE PORTION (PURE NICKEL) |
|---|---|---|
| (1) 229.1<br>(2) 233.2<br>(3) 225.9<br>(4) 229.9<br>(5) 247.0<br>(6) 230.7 | (7) 70.7<br>(8) 78.8<br>(9) 72.1<br>(10) 75.4<br>(11) 73.1<br>(12) 78.4 | (13) 123.2<br>(14) 129.8<br>(15) 125.1 |
| AVE 232.6 | AVE 74.8 | AVE 126.0 |

(a)

(b)

(a)

(b)

SPARK PLUG

FIELD OF THE INVENTION

The present invention relates to a spark plug.

BACKGROUND OF THE INVENTION

Japanese Patent Application Laid-Open (kokai) No. 11-185928, hereinafter "Patent Document 1," discloses a conventional spark plug. The spark plug includes a ground electrode. The ground electrode has a proximal end section fixed to a metallic shell, a bent section formed integral with the proximal end section, and a distal end section formed integral with the bent section and adapted to form a spark discharge gap in cooperation with a center electrode.

The ground electrode is configured to have a core portion extending from the proximal end section toward the distal end section via the bent section, a heat transfer portion located externally of the core portion and extending from the proximal end section toward the distal end section via the bent section, and an external layer located externally of the core portion and the heat transfer portion and extending from the proximal end section to the distal end section via the bent section. As viewed on a section taken orthogonally to a direction along which the ground electrode extends, the centers of the external layer, the heat transfer portion, and the core portion coincide.

The external layer is formed from a nickel-based alloy, which serves as a first metal; the heat transfer portion is formed from copper, which serves as a second metal; and the core portion is formed from pure nickel, which serves as a third metal. The nickel-based alloy used to form the external layer is excellent in heat resistance and corrosion resistance. Copper used to form the heat transfer portion has a thermal conductivity of 390 W/m·K, which is higher than that of the nickel-based alloy. Pure nickel used to form the core portion has a Vickers hardness Hv of 125, which is higher than the Vickers hardness Hv of copper (Hv 75). Copper used to form the heat transfer portion has a linear thermal expansion coefficient of $1.65\times10^{-5}$/° C., which is higher than the linear thermal expansion coefficient of the nickel-based alloy ($1.34\times10^{-5}$/° C.) and the linear thermal expansion coefficient of pure nickel ($1.30\times10^{-5}$/° C.).

The thus-configured conventional spark plug is mounted on an engine and repeatedly discharges between the center electrode and the ground electrode under a high temperature condition.

During the repeated discharge of the spark plug, by virtue of excellent thermal conductivity of the second metal used to form the heat transfer portion, the heat transfer portion effectively conducts heat from the distal end section to the proximal end section. That is, in the spark plug, by virtue of excellent heat transfer performance of the heat transfer portion, an increase in temperature of the distal end section is restrained, so that excellent durability can be exhibited.

Meanwhile, because of the high linear thermal coefficient of the second metal used to form the heat transfer portion, the ground electrode of the spark plug tends to rise under a high temperature condition. Upon occurrence of the rising of the ground electrode, the discharge gap between the ground electrode and the center electrode changes, causing an adverse effect on characteristics. Thus, in the spark plug, such rising of the ground electrode is restrained through adjustment of the thicknesses of the heat transfer portion and the external layer. Conceivably, the reinforcement effect of the core portion implemented by the third metal used to form the core portion being higher in hardness than the second metal used to form the heat transfer portion contributes to restraint of the rising of the ground electrode.

SUMMARY OF THE INVENTION

Spark plugs tend to be reduced in diameter in order to save space. Thus, a further reduction in size of ground electrodes has been required. In the above-mentioned spark plug, reducing the size of the ground electrode is accompanied by a reduction in the volume of the heat transfer portion, so that heat transfer from the distal end section becomes insufficient. Further, since the core portion becomes thin, the above-mentioned reinforcement effect is impaired. As a result, the conventional spark plug involves a problem in that the rising of the ground electrode is apt to occur.

The present invention has been conceived in view of the foregoing fact, and an object of the invention is to provide a spark plug in which the rising of a ground electrode can be more reliably restrained.

The inventors of the present invention have carried out extensive studies for solving the above-mentioned problems and have developed the present invention, focusing on the positional relation between a core portion and a heat transfer portion as viewed on a section of a ground electrode taken orthogonally to a direction along which the ground electrode extends.

The present invention provides a spark plug which includes a ground electrode having a proximal end section fixed to a metallic shell, a bent section formed integral with the proximal end section, and a distal end section formed integral with the bent section and adapted to form a spark discharge gap in cooperation with a center electrode and in which the ground electrode is configured to have a core portion extending from the proximal end section toward the distal end section via the bent section, a heat transfer portion extending from the proximal end section toward the distal end section via the bent section, and an external layer located externally of the core portion and the heat transfer portion and extending from the proximal end section to the distal end section via the bent section, the external layer is formed from a first metal being excellent in heat resistance and corrosion resistance, the heat transfer portion is formed from a second metal higher in thermal conductivity than the first metal, the core portion is formed from a third metal higher in hardness than the second metal, and the second metal is higher in linear thermal expansion coefficient than the first metal and the third metal, wherein, as viewed on a section of the ground electrode taken orthogonally to a direction along which the ground electrode extends, at least at an intermediate position of the bent section with respect to the direction, a center of the core portion is offset toward the center electrode from a center of the heat transfer portion (first aspect of the present invention).

In the thus-configured spark plug of the present invention, since the second metal used to form the heat transfer portion is high in linear thermal expansion coefficient, the ground electrode attempts to rise under a high temperature condition. However, in the spark plug, as viewed on a section of the ground electrode taken orthogonally to a direction along which the ground electrode extends, at least at an intermediate position of the bent section with respect to the direction, the center of the core portion, which is lower in linear thermal expansion coefficient and higher in hardness than the heat transfer portion, is offset toward the center electrode from the center of the heat transfer portion. Thus, in the spark plug of the present invention, in contrast to the conventional spark plug in which the center of the heat transfer portion and the center of the core portion coincide, by virtue of the difference in thermal expansion between the heat transfer portion and the core portion, the heat transfer portion and the core portion collectively function as a so-called bimetal in such a manner as to increase the degree of bending of the bent section. Thus, the spark plug can weaken the tendency for the ground electrode to rise under a high temperature condition.

Thus, the spark plug of the present invention can reliably restrain the rising of the ground electrode. As a result, even when the size of the ground electrode is reduced for reducing the diameter of the spark plug, the spark plug can restrain the rising of the ground electrode, thereby restraining a change in spark discharge gap between the ground electrode and the center electrode. Therefore, an adverse effect on characteristics can be avoided. Notably, Vickers hardness can be employed as a scale indicative of hardness of metal.

Also, within a range in which the rising of the ground electrode can be restrained, the spark plug can improve heat transfer performance by means of further extending, toward the distal end section, the heat transfer portion whose volume is reduced in association with reduction in size.

Notably, the external layer in the present invention does not include a thin film formed by surface treatment, such as plating.

The sectional shapes of the core portion and the heat transfer portion are not limited to rectangular, but may be, for example, circular, elliptical, triangular, or polygonal. The center of the core portion and the center of the heat transfer portion are more specifically barycenters (i.e., "centroid" or "geometric center") of sectional figures of the core portion and the heat transfer portion.

Further, in the spark plug of the present invention, the core portion may be located within the heat transfer portion; the heat transfer portion may be located within the core portion; the core portion may partially project from the heat transfer portion; the heat transfer portion may partially project from the core portion; or the core portion and the heat transfer portion may be disposed independent of each other.

Preferably, the spark plug of the present invention has at least one configuration in which, as viewed on a section of the ground electrode taken orthogonally to a direction along which the ground electrode extends, at least at an intermediate position of the bent section with respect to the direction, the core portion is eccentrically positioned toward the center electrode and a configuration in which, as viewed on a section of the ground electrode taken orthogonally to a direction along which the ground electrode extends, at least at an intermediate position of the bent section with respect to the direction, the heat transfer portion is eccentrically positioned toward a side opposite the center electrode (second aspect of the present invention). Through employment of such a specific configuration, the spark plug can reliably yield the actions and effects of the present invention.

The spark plug according to the above-mentioned second aspect of the present invention can be such that, as viewed on a section of the ground electrode taken orthogonally to a direction along which the ground electrode extends, at least at an intermediate position of the bent section with respect to the direction, the core portion is located at a center between a side of the section located on a side toward the center electrode and a side of the section located on a side opposite the center electrode, and the heat transfer portion is eccentrically positioned toward the side opposite the center electrode (third aspect of the present invention).

In this case, by virtue of the eccentric disposition of the heat transfer portion toward the side opposite the center electrode, a region of the heat transfer portion located on the side opposite the center electrode is greater in sectional area than a region of the heat transfer portion located on the side toward the center electrode. Thus, in the spark plug, the heat transfer portion and the core portion collectively function as a bimetal more effectively in such a manner as to increase the degree of bending of the bent section. Therefore, the spark plug can reliably yield the actions and effects of the present invention.

Also, the spark plug according to the above-mentioned second aspect of the present invention can be such that, as viewed on a section of the ground electrode taken orthogonally to a direction along which the ground electrode extends, at least at an intermediate position of the bent section with respect to the direction, the core portion is eccentrically positioned toward the center electrode, and the heat transfer portion is eccentrically positioned toward the side opposite the center electrode (fourth aspect of the present invention).

In this case, by virtue of the eccentric disposition of the core portion toward the center electrode and the eccentric disposition of the heat transfer portion toward the side opposite the center electrode, a region of the heat transfer portion located on the side opposite the center electrode is reliably greater in sectional area than a region of the heat transfer portion located on the side toward the center electrode. Thus, in the spark plug, the heat transfer portion and the core portion collectively function as a bimetal more effectively in such a manner as to increase the degree of bending of the bent section. Therefore, the spark plug can reliably yield the actions and effects of the present invention.

Further, the spark plug according to the above-mentioned second aspect of the present invention can be such that, as viewed on a section of the ground electrode taken orthogonally to a direction along which the ground electrode extends, at least at an intermediate position of the bent section with respect to the direction, the heat transfer portion is located at a center between a side of the section located on a side toward the center electrode and a side of the section located on a side opposite the center electrode, and the core portion is eccentrically positioned toward the center electrode (fifth aspect of the present invention).

In this case, by virtue of the eccentric disposition of the core portion toward the center electrode, a region of the heat transfer portion located on the side opposite the center electrode is greater in sectional area than a region of the heat transfer portion located on the side toward the center electrode. Thus, in the spark plug, the heat transfer portion and the core portion collectively function as a bimetal more effectively in such a manner as to increase the degree of bending of the bent section. Therefore, the spark plug can reliably yield the actions and effects of the present invention.

Preferably, the spark plug according to the above-mentioned fifth aspect of the present invention is such that, as viewed on a section of the ground electrode taken orthogonally to a direction along which the ground electrode extends, when eccentricity is taken as 0% for a state in which the center of the heat transfer portion and the center of the core portion coincide, and eccentricity is taken as 100% for a state in which the core portion is in contact with the external layer, the eccentricity of the core portion is 50% or greater (sixth aspect of the present invention).

In this case, in the spark plug, a region of the heat transfer portion located on the side opposite the center electrode is reliably greater in sectional area than a region of the heat transfer portion located on the side toward the center electrode. Also, the core portion projects far into the region of the heat transfer portion located on the side toward the center electrode. Thus, in the spark plug, the heat transfer portion and the core portion collectively exhibit the above-mentioned action of a bimetal more readily in such a manner as to further increase the degree of bending of the bent section. Therefore, the spark plug can reliably yield the actions and effects of the present invention.

The present invention includes not only a state in which the core portion is in contact with the external layer but also a state in which the core portion projects into the external layer. In this case, the eccentricity of the core portion is in excess of 100%.

Preferably, the spark plug according to the above-mentioned fifth and sixth aspects of the present invention has a relation $(Z_1 \times Hv_1 + Z_3 \times Hv_3)/S_2 \times \alpha_2 < 1.5 \times 10^7$, wherein $Z_1$ is section modulus of the external layer, $Z_3$ is section modulus of the core portion, $Hv_1$ is Vickers hardness of the first metal, $Hv_3$ is Vickers hardness of the third metal, $S_2$ is sectional area of the heat transfer portion, and $\alpha_2$ is linear thermal expansion coefficient of the second metal (seventh aspect of the present invention).

The inventors of the present invention have analyzed the results of experiments and analyses performed on conventional spark plugs and the spark plug of the present invention, and have empirically found the above-mentioned relational expression. Through fulfillment of the relational expression, the spark plug of the present invention can reliably yield the actions and effects of the present invention.

Preferably, in the spark plug of the present invention, hardness of the third metal is higher than that of the first metal, and hardness of the first metal is higher than that of the second metal (eighth aspect of the present invention.

For example, in the spark plug described in Patent Document 1, hardness (a Vickers hardness Hv of about 100 to 230) of a nickel-based alloy, which serves as the first metal, is higher than the hardness (a Vickers hardness Hv of 125) of pure nickel, which serves as the third metal. Generally, in conventional spark plugs, hardness of the first metal is higher than that of the third metal. By contrast, in the spark plug of the present invention, through employment of the third metal higher in hardness than the first and second metals, the reinforcement effect of the core portion can be improved, so that the spark plug can more reliably yield the actions and effects of the present invention.

Specific examples of the first metal include nickel-based alloys, such as an Ni—Mn—Si alloy, an Ni—Mn—Si—Cr alloy, and an Ni—Mn—Si—Cr—Al alloy, INCONEL 600, and INCONEL 601 ("INCONEL" is a registered trademark).

Specific examples of the second metal include pure copper, copper alloys, and silver.

Specific examples of the third metal include pure nickel, pure iron, INCONEL 600, INCONEL 601, HASTELLOY A, HASTELLOY B, and HASTELLOY C ("HASTELLOY" is a registered trademark). Particularly, the hardness (a Vickers hardness Hv of about 170 to 250) of INCONEL 600, INCONEL 601, HASTELLOY A, HASTELLOY B, HASTELLOY C, etc. is higher than that of a nickel-based alloy, which is generally used as the first metal. Thus, through employment of any one of these alloys as the third metal, the reinforcement effect of the core portion can be reliably improved.

Preferably, the spark plug of the present invention is such that, as viewed on a section of the ground electrode taken orthogonally to a direction along which the ground electrode extends, the positional relations are established over the entire region of the bent section along the direction (ninth aspect of the present invention.

In this case, over the entire region of the bent section along the direction, the center of the core portion, which is lower in linear thermal expansion coefficient and higher in hardness than the heat transfer portion, is offset toward the center electrode from the center of the heat transfer portion. Thus, in the spark plug, the heat transfer portion and the core portion collectively exhibit the above-mentioned action of a bimetal more readily in such a manner as to further increase the degree of bending of the bent section. Therefore, the spark plug can reliably yield the actions and effects of the present invention.

DETAILED DESCRIPTION OF THE INVENTION

The first to seventh embodiments of the present invention will now be described with reference to the drawings.

First Embodiment

Figure 1:
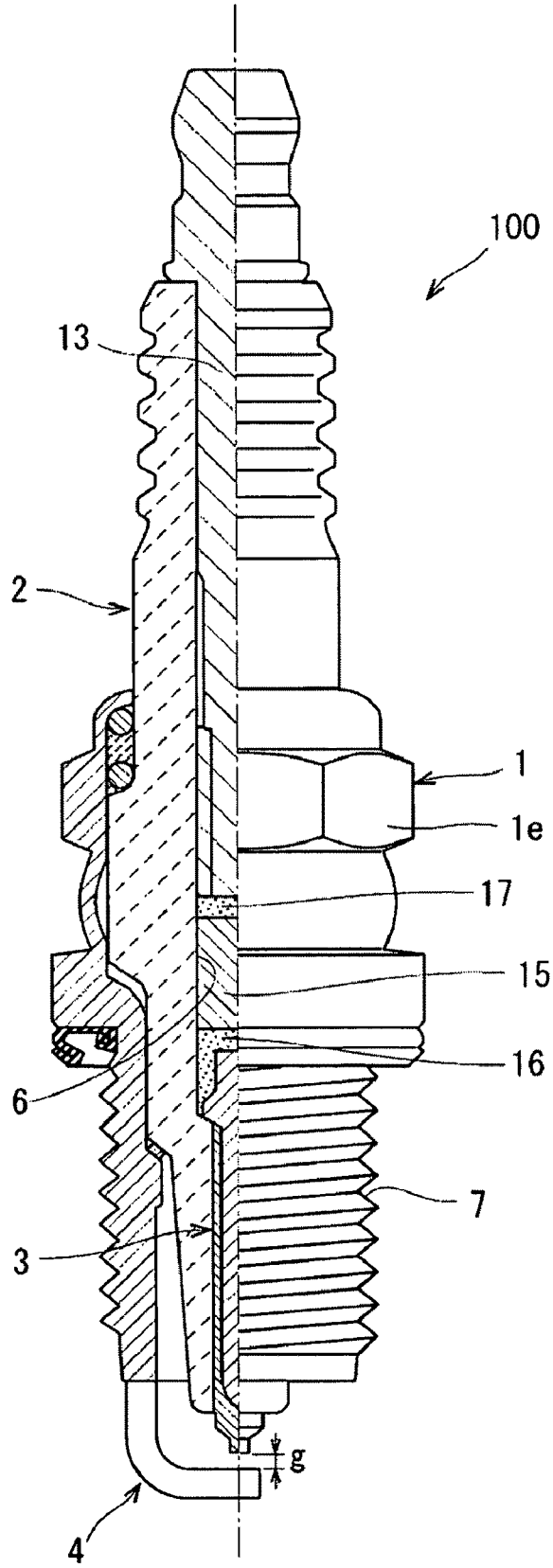
FIG. 1 is a front view (partially sectional view) of a spark plug according to a first embodiment of the present invention.
Figure 2:
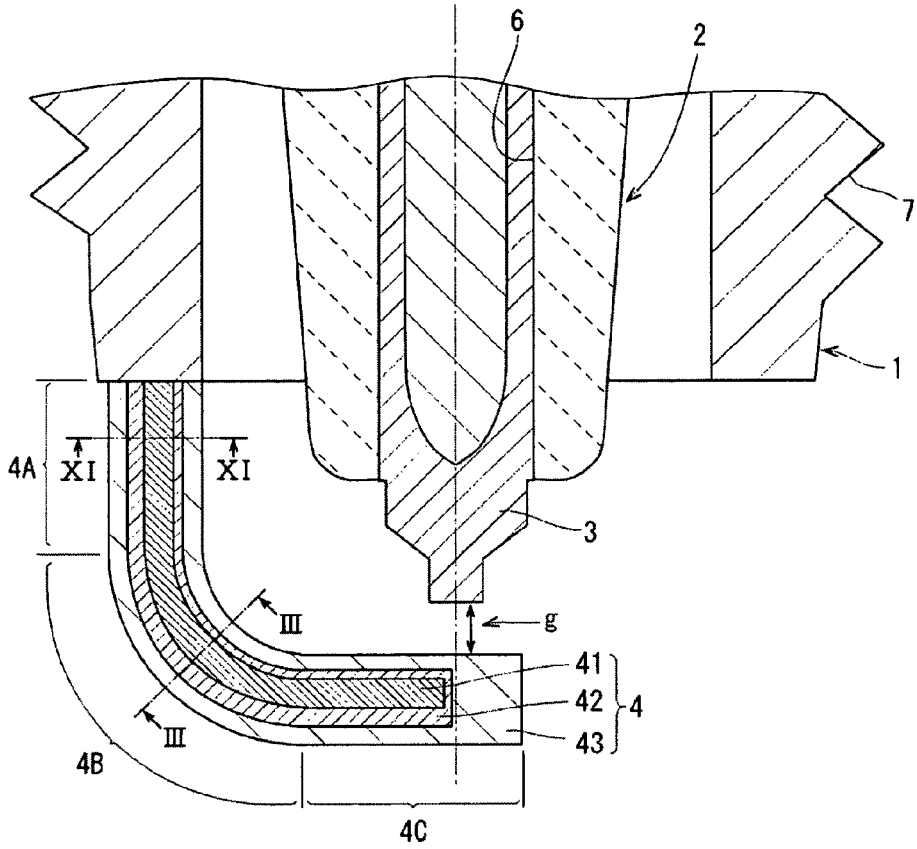
FIG. 2 is an enlarged sectional view of essential portions of the spark plug according to the first embodiment.

As shown in FIGS. 1 and 2, a spark plug 100 of the first embodiment includes a metallic shell 1, an insulator 2, a center electrode 3, and a ground electrode 4. In FIGS. 1 and 2, the lower side of paper corresponds to the front side of the spark plug 100, and the upper side of paper corresponds to the rear side of the spark plug 100.

The metallic shell 1 is formed into a cylindrical shape from metal, such as low-carbon steel, and serves as the housing of the spark plug 100. The metallic shell 1 has a threaded portion 7 and a tool engagement portion 1*e* formed on its outer circumferential surface. The threaded portion 7 is adapted to mount the spark plug 100 to an unillustrated engine. The tool engagement portion 1*e* has a hexagonal cross-sectional shape. In mounting the metallic shell 1, a tool, such as a spanner or a wrench, is engaged with the tool engagement portion 1*e*.

The insulator 2 is formed from an electrically insulative material which predominantly contains alumina or the like. The insulator 2 is fitted into the metallic shell 1 in such a manner that its front end projects from the metallic shell 1. The insulator 2 has a through hole 6 which is formed in the axial direction and into which a center electrode 3 and a terminal electrode 13 are inserted. The center electrode 3 is fixedly inserted at the front side of the through hole 6, whereas the terminal electrode 13 is fixedly inserted at the rear side of the through hole 6. Within the through hole 6, a resistor 15 is disposed between the terminal electrode 13 and the center electrode 3. Opposite end portions of the resistor 15 are electrically connected to the center electrode 3 and the terminal electrode 13 via electrically conductive glass seal layers 16 and 17, respectively. The resistor 15 is formed from a resistor composition, which is formed by the steps of mixing powder of glass and powder of an electrically conductive material (and powder of a ceramic other than glass as needed) and firing the resultant mixture by use of a hot press or the like.

The center electrode 3 is a columnar body formed from a nickel-based alloy or the like. A front end of the center electrode 3 is formed into a substantially conical shape and projects from the front end of the through hole 6.

As shown on an enlarged scale in FIG. 2, the ground electrode 4 is composed of a proximal end section 4A fixed to the rim of the front end opening of the metallic shell 1 by welding or the like, a bent section 4B formed integral with the proximal end section 4A and arcuately bent substantially at a right angle, and a distal end section 4C formed integral with the bent section 4B and facing the center electrode 3. A spark discharge gap g is formed between the center electrode 3 and the distal end section 4C of the ground electrode 4.

The ground electrode 4 is a shaft body of a three-layer structure having a substantially rectangular cross-section. The ground electrode 4 has a core portion 41 extending from the proximal end section 4A toward the distal end section 4C via the bent section 4B, a heat transfer portion 42 located externally of the core portion 41 and extending from the proximal end section 4A toward the distal end section 4C via the bent section 4B, and an external layer 43 located externally of the core portion 41 and the heat transfer portion 42 and extending from the proximal end section 4A to the distal end section 4C via the bent section 4B. The external layer 43 extends up to the distal end of the distal end section 4C. The core portion 41 and the heat transfer portion 42 extend to the vicinity of the axis of the center electrode 3 in the distal end section 4C. How far to extend the core portion 41 and the heat transfer portion 42 toward the distal end of the distal end section 4C (on the proximal side or the distal side with respect to the axis of the center electrode 3) is adjusted as appropriate according to required performance, such as required heat transfer performance.

The external layer 43 is formed from a nickel-based alloy (INCONEL 600 or INCONEL 601), which is an example of the first metal; the heat transfer portion 42 is formed from copper, which is an example of the second metal; and the core portion 41 is formed from pure nickel, which is an example of the third metal. The nickel-based alloy used to form the external layer 43 is superior to copper and pure nickel in heat resistance and corrosion resistance. Copper used to form the heat transfer portion 42 has a thermal conductivity of 390 W/m·K, which is higher than that of the nickel-based alloy. Pure nickel used to form the core portion 41 has a Vickers hardness Hv of 125, which is higher than a Vickers hardness Hv of 75 of the heat transfer portion 42, but is lower than a Vickers hardness Hv of 230 of the external layer 43. Also, copper used to form the heat transfer portion 42 has a linear thermal expansion coefficient of $1.65\times10^{-5}/°$ C., which is higher than the linear thermal expansion coefficient of the nickel-based alloy ($1.34\times10^{-5}/°$ C.) and the linear thermal expansion coefficient of pure nickel ($1.30\times10^{-5}/°$ C.).

Figure 3:
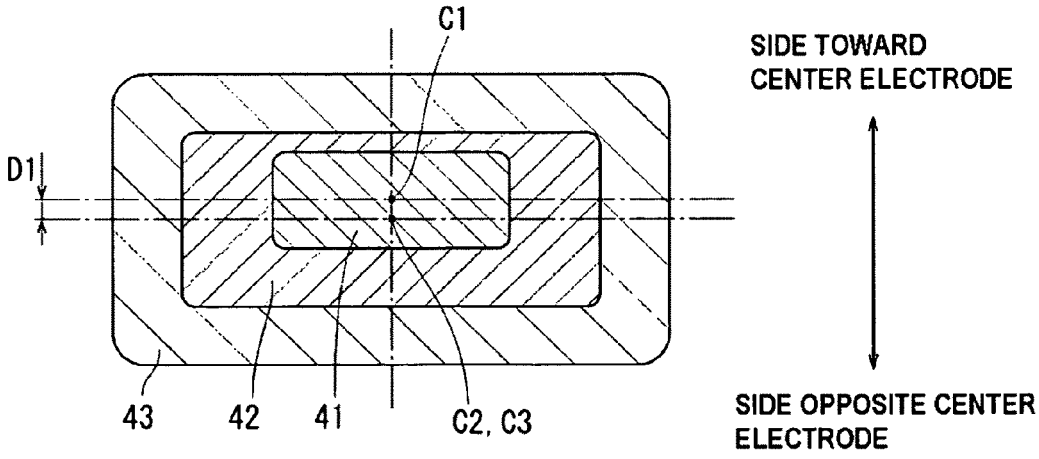
FIG. 3 is a sectional view, taken along line III-III of FIG. 2, of a ground electrode of the spark plug according to the first embodiment.

As shown in FIG. 3, as viewed on a section of the ground electrode 4 taken orthogonally to a direction along which the ground electrode 4 extends, and located at an intermediate position of the bent section 4B with respect to the direction (section taken along line III-III of FIG. 2), the centroid (barycenter of rectangular section) C2 of the heat transfer portion 42 coincides with the centroid (barycenter of rectangular section) C3 of the external layer 43. Meanwhile, the centroid (barycenter of rectangular section) C1 of the core portion 41 is offset toward the center electrode 3 from the centroid C2 of the heat transfer portion 42. In other words, at the intermediate position (section taken along line III-III of FIG. 2) of the bend section 4B, the centroid C2 of the heat transfer portion 42 is located at the center between a side of the section located on a side toward the center electrode 3 and a side of the section located on a side opposite the center electrode 3, and the centroid C1 of the core portion 41 is eccentrically positioned toward the center electrode 3. As shown in FIG. 2, the relative positional relation between the core portion 41 and the heat transfer portion 42 is similar to that shown in the section of FIG. 3 over the entire region along the direction along which the core portion 41 and the heat transfer portion 42 extend. That is, over the entire region of the bent section 4B along the direction, the heat transfer portion 42 is located at the center between a side of the section located on the side toward the center electrode 3 and a side of the section located on the side opposite the center electrode 3, and the core portion 41 is eccentrically positioned toward the center electrode 3.

Figure 4:
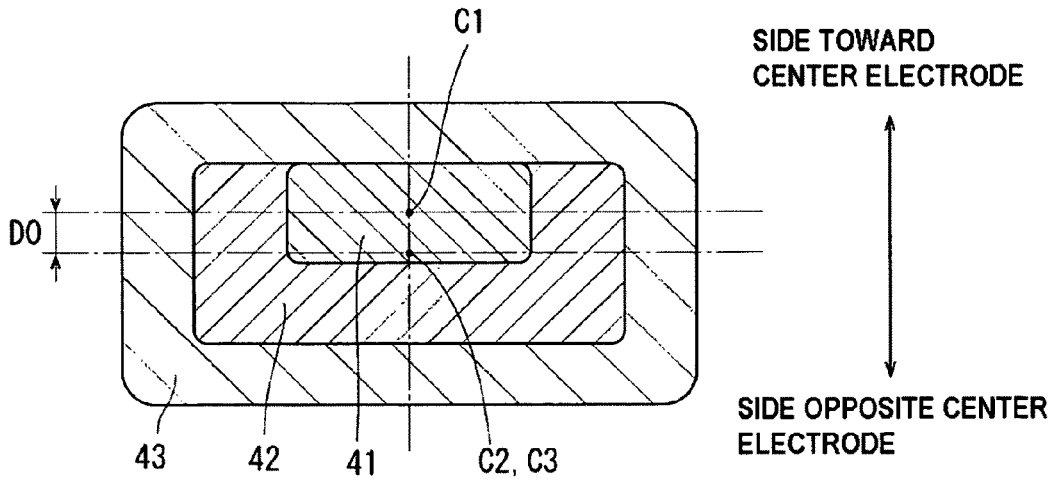
FIG. 4 is a sectional view, similar to that of FIG. 3, of a ground electrode of another spark plug according to the first embodiment.

In the first embodiment, a scale indicative of to what degree the core portion 41 is eccentric to the heat transfer portion 42 is defined as eccentricity (%) as mentioned below. Specifically, the eccentricity is taken as 100% for a state in which the core portion 41 is in contact with the external layer 43 as shown in FIG. 4, and the distance between the centroid C1 of the core portion 41 and the centroid C2 of the heat transfer portion 42 in this case is taken as D0. Although unillustrated, the eccentricity is taken as 0% for a state in which the centroid C2 of the heat transfer portion 42 and the centroid C1 of the core portion 41 coincide. For example, in the case shown in FIG. 3, when the distance between the centroid C1 of the core portion 41 and the centroid C2 of the heat transfer portion 42 is taken as D1, the eccentricity (%) is calculated by the following expression.

$$\text{Eccentricity}(\%)=D1/D0\times100$$

Figure 5:
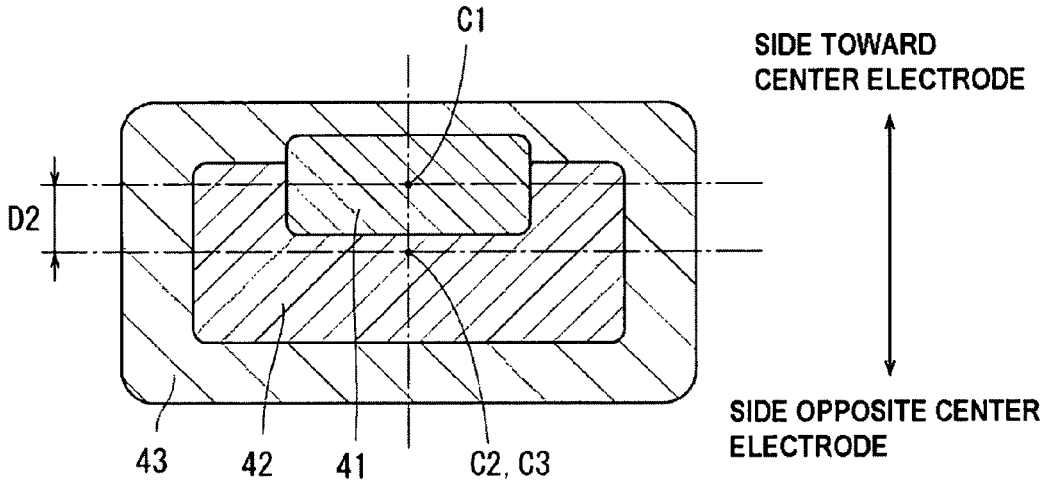
FIG. 5 is a sectional view, similar to that of FIG. 3, of a ground electrode of still another spark plug according to the first embodiment.

The eccentricity (%) can assume a value greater than 100%. Specifically, as shown in FIG. 5, in the case where the core portion 41 projects into the external layer 43, when the distance between the centroid C1 of the core portion 41 and the centroid C2 of the heat transfer portion 42 is taken as D2, D2 is greater than D0; thus, the eccentricity (%) is greater than 100% as expressed below.

$$\text{Eccentricity}(\%)=D2/D0\times100>100$$

The thus-configured spark plug 100 of the first embodiment is mounted on an unillustrated engine and repeats discharge between the center electrode 3 and the ground electrode 4 under a high temperature condition.

During the repeated discharge, in the spark plug 100, since copper used as an example second metal for forming the heat transfer portion 42 has excellent thermal conductivity, the heat transfer portion 42 effectively conducts heat from the distal end section 4C to the proximal end section 4A. That is, in the spark plug 100, by virtue of excellent heat transfer performance of the heat transfer portion 42, an increase in temperature of the distal end section 4C is restrained, so that excellent durability can be exhibited.

Meanwhile, in the spark plug 100, since copper used as an example second metal for forming the heat transfer portion 42 has high linear thermal expansion coefficient, if no measures are taken, the ground electrode 4 will tend to rise under a high temperature condition. If the ground electrode 4 rises, the discharge gap g between the ground electrode 4 and the center electrode 3 changes, causing an adverse effect on characteristics.

However, in the spark plug 100, as mentioned above, at least at an intermediate position of the bent section 4B with respect to the direction along which the ground electrode 4 extends (section taken along line III-III of FIG. 2), the centroid C1 of the core portion 41 is offset toward the center electrode 3 from the centroid C2 of the heat transfer portion 42. More specifically, the centroid C2 of the heat transfer portion 42 is located at the center between a side of the section located on a side toward the center electrode 3 and a side of the section located on a side opposite the center electrode 3, and the centroid C1 of the core portion 41 is eccentrically positioned toward the center electrode 3. Thus, as shown in FIG. 3, at least at an intermediate position of the bent section 4B with respect to the direction, a region of the heat transfer portion 42 located on the side opposite the center electrode 3 is greater in sectional area than a region of the heat transfer portion 42 located on the side toward the center electrode 3. Additionally, the core portion 41, which is lower in linear thermal expansion coefficient and higher in hardness than the heat transfer portion 42, projects into the region of the heat transfer portion 42 located on the side toward the center electrode 3. Thus, in the spark plug 100, in contrast to the conventional spark plug in which the center of the heat transfer portion and the center of the core portion coincide, by virtue of the difference in thermal expansion between the heat transfer portion 42 and the core portion 41, the heat transfer portion 42 and the core portion 41 collectively function as a so-called bimetal in such a manner as to increase the degree of bending of the bent section 4B. Thus, the spark plug 100 can weaken the tendency for the ground electrode 4 to rise under a high temperature condition.

Thus, the spark plug 100 of the first embodiment can reliably restrain the rising of the ground electrode 4. As a result, even when the size of the ground electrode 4 is reduced for reducing the diameter of the spark plug 100, the spark plug 100 can restrain the rising of the ground electrode 4, thereby restraining a change in the spark discharge gap g between the ground electrode 4 and the center electrode 3. Therefore, an adverse effect on characteristics can be avoided.

Also, within a range in which the rising of the ground electrode 4 can be restrained, the spark plug 100 can improve heat transfer performance by means of further extending, toward the distal end section 4C, the heat transfer portion 42 whose volume is reduced in association with reduction in size.

Further, in the spark plug 100, as mentioned above, the core portion 41 is eccentrically positioned toward the center electrode 3 over the entire region of the bent section 4B along the direction along which the ground electrode 4 extends. Thus, over the entire region of the bent section 4B along the direction, a region of the heat transfer portion 42 located on the side opposite the center electrode 3 is greater in sectional area than a region of the heat transfer portion 42 located on the side toward the center electrode 3. Also, over the entire region of the bent section 4B along the direction, the core portion 41 projects into the region of the heat transfer portion 42 located on the side toward the center electrode 3. Thus, in the spark plug 100, the heat transfer portion 42 and the core portion 41 collectively exhibit the above-mentioned action of a bimetal more readily in such a manner as to further increase the degree of bending of the bent section 4B. Therefore, the spark plug 100 can reliably yield the actions and effects of the present invention.

Test Examples 1-1 to 1-5 for supporting the description of actions and effects of the spark plug 100 of the first embodiment will now be described in detail.

Test Example 1-1

Figure 6:
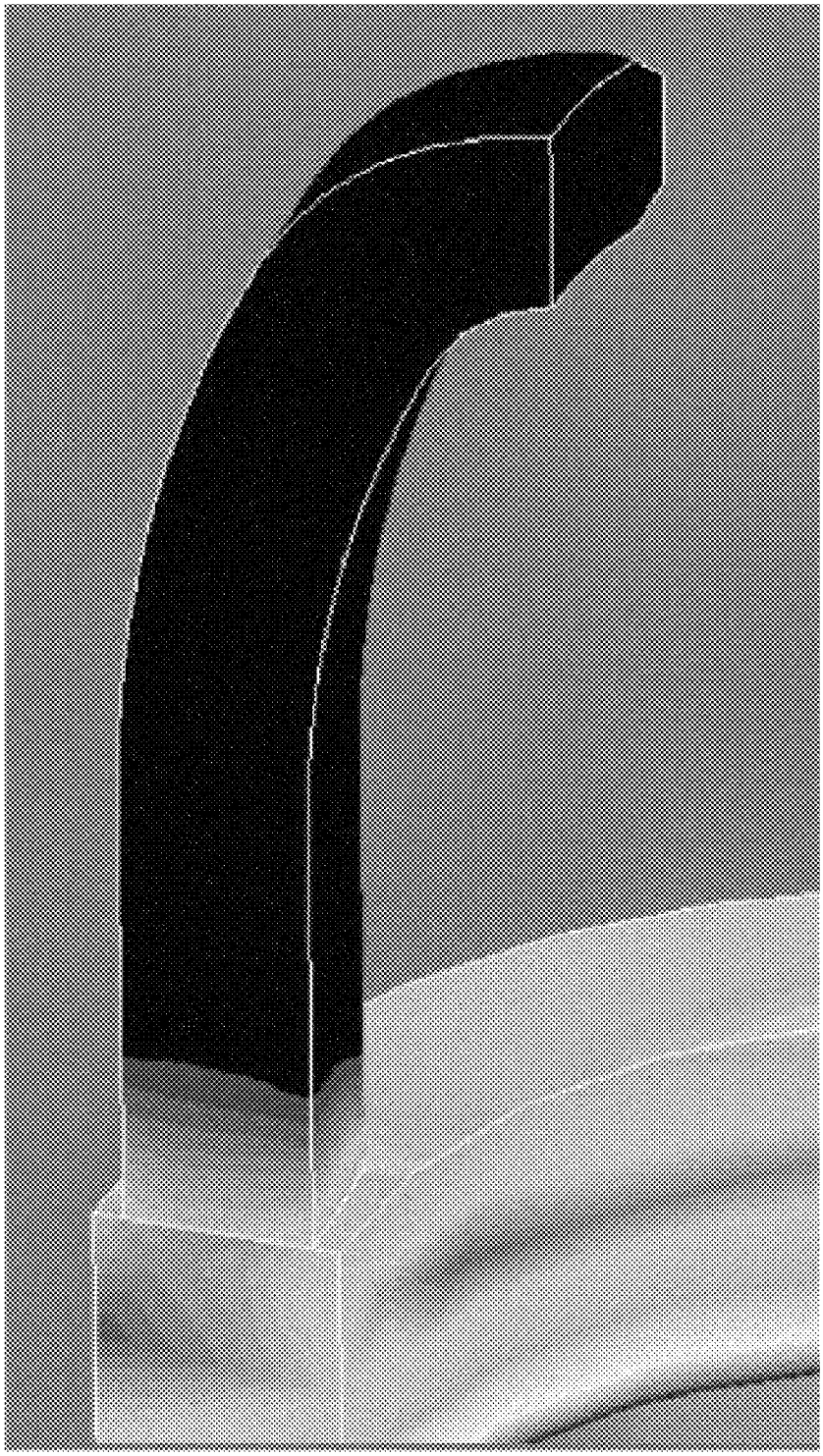
FIG. 6 is a photograph showing the distribution of thermal stress in a ground electrode of Test Example 1-1.

Test Example 1-1 used, as shown in the photo of FIG. 6, a ground electrode formed from a shaft body of a solid nickel-based alloy having a substantially rectangular section. The ground electrode was subjected to FEM thermal stress analysis for thermal stress distribution under a high temperature condition. The ground electrode has a structure simpler than that of the conventional ground electrode disclosed in Patent Document 1 or the like. In FIG. 6, a thermal stress distribution is represented by monochromatic shading. The lighter the shade, the higher the thermal stress. FIG. 6 shows only the proximal end section and the bent section and does not show the distal end section.

Conditions of the analysis were as follows: the engine head temperature was set to 350° C. to 150° C., and the heat transfer coefficient between the ground electrode and the atmosphere within the engine was set to 360 $W/m^{2\cdot}$° C. The temperature of the atmosphere was set such that a region located 1 mm inward from the end of the distal end section of the ground electrode had a temperature of 1,000° C.

As a result, in Test Example 1-1, the temperature of the atmosphere was 1,490° C. In this case, as shown in FIG. 6, thermal stresses of the same level are generated throughout the proximal end section and the intermediate section of the ground electrode.

Test Example 1-2

Figure 7:
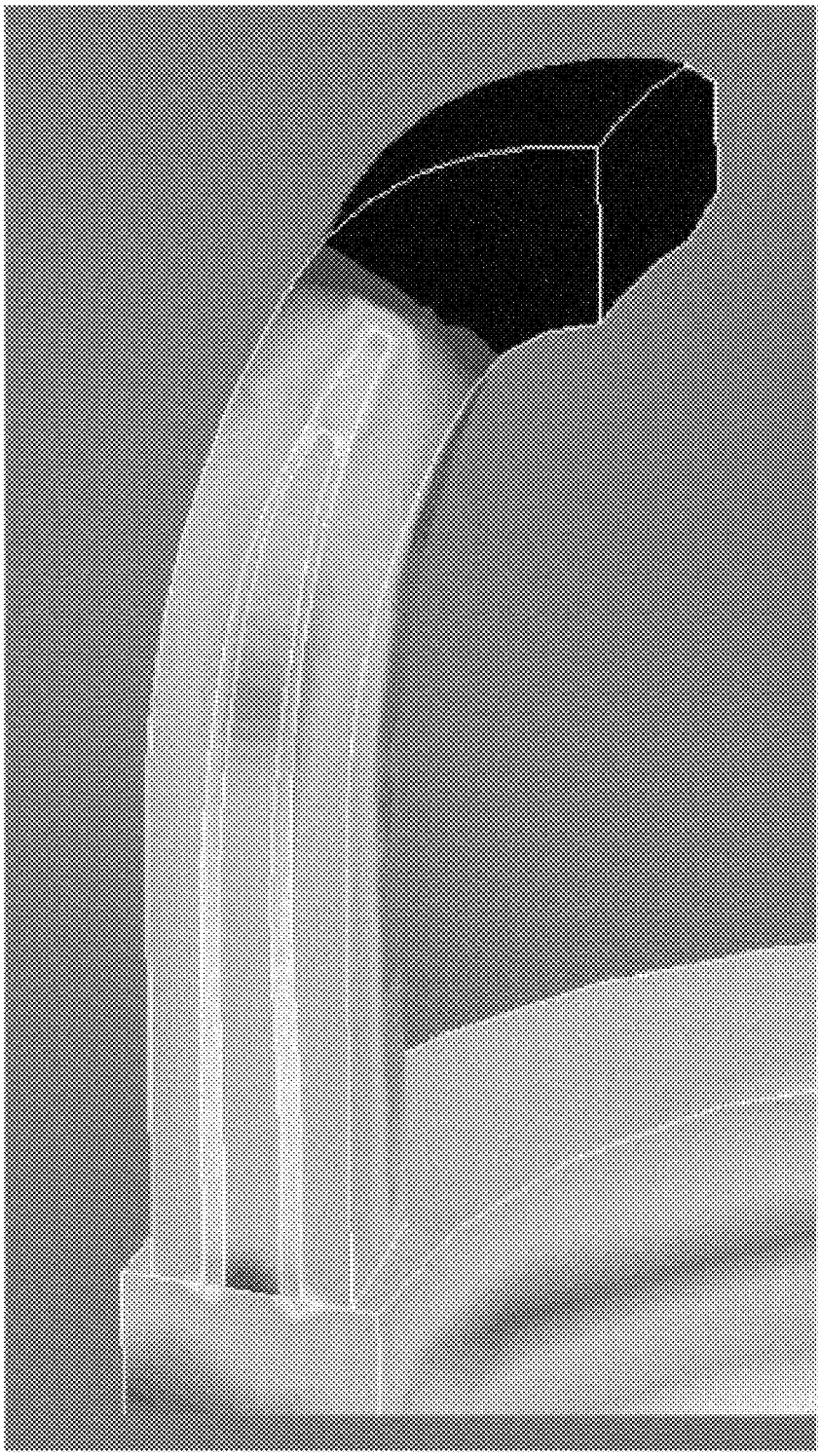
FIG. 7 is a photograph showing the distribution of thermal stress in a ground electrode of Test Example 1-2.

Test Example 1-2 used, as shown in the photo of FIG. 7, a ground electrode which was formed from a shaft body of a 3-layer structure consisting of a core portion, a heat transfer portion, and an external layer and in which the center of the core portion and the center of the heat transfer portion coincided (eccentricity 0%). The ground electrode was subjected to FEM thermal stress analysis for thermal stress distribution under a high temperature condition. The ground electrode is the one of the conventional structure disclosed in Patent Document 1 or the like. In FIG. 7, similar to FIG. 6, a thermal stress distribution is represented by monochromatic shading. The lighter the shade, the higher the thermal stress. FIG. 7 also shows only the proximal end section and the bent section and does not show the distal end section.

Similar to Test Example 1-1, the temperature of the atmosphere was set such that a region located 1 mm inward from the end of the distal end section of the ground electrode had a temperature of 1,000° C.

As a result, in Test Example 1-2, the temperature of the atmosphere was 1,570° C.; i.e., the temperature of the atmosphere was higher than in Test Example 1-1. This indicates that, by virtue of heat transfer of the heat transfer portion formed from copper, heat of the distal end section is conducted to the proximal end section, thereby restraining an increase in temperature of the distal end section. Also, as shown in FIG. 7, high thermal stresses are generated between the heat transfer portion and the external layer and between the heat transfer portion and the core portion. The thermal expansion of the heat transfer portion is presumed to be a main cause for the generation of thermal stresses. The thermally expanded heat transfer portion is presumed to press the external layer, causing the occurrence of rising of the ground electrode.

Test Example 1-3

Figure 8:
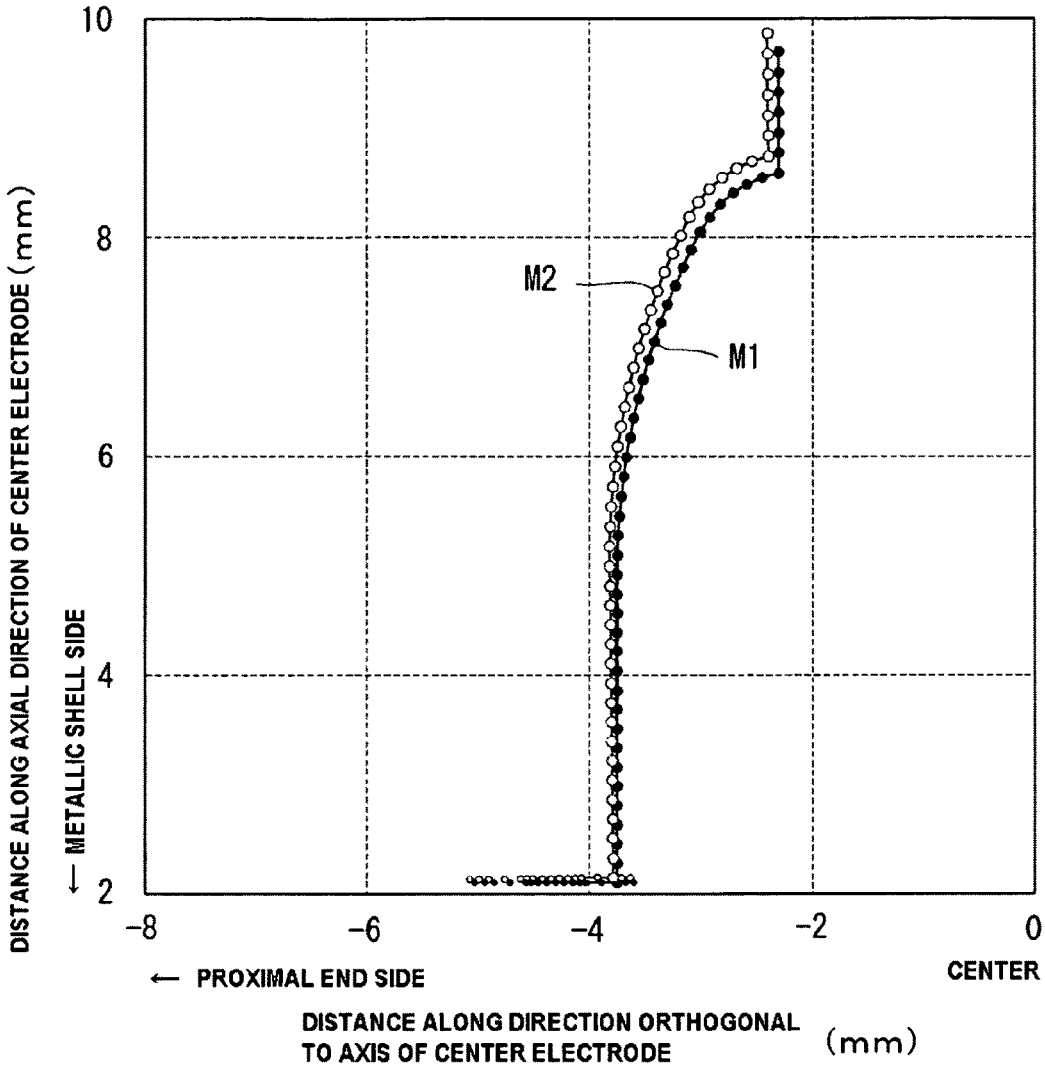
FIG. 8 is a graph showing a change in shape of a ground electrode of Test Example 1-3.

Test Example 1-3, as shown in FIG. 8, analyzed, by FEM, the ground electrode of Test Example 1-2 having an eccentricity of 0% for a change in the shape of the ground electrode between a state before start of the FEM thermal stress analysis and a state in which the temperature of the atmosphere had reached 1,570° C. in the course of the FEM thermal stress analysis. FIG. 8 shows only the proximal end section and the bent section and does not show the distal end section.

As a result, in contrast to a state before start of the FEM thermal analysis (as represented by the line M1 shown in FIG. 8), in a state in which the temperature of the atmosphere had reached 1,570° C. in the course of the FEM thermal stress analysis (as represented by the line M2 shown in FIG. 8), the rising of the ground electrode occurred. Conceivably, as mentioned above, this is caused by the thermally expanded heat transfer portion pressing the external layer.

Test Example 1-4

Test Example 1-4 analyzed, by FEM, the ground electrode of Test Example 1-2 having an eccentricity of 0% for the degree of a drop in the temperature of the distal end section while the distal end position of the heat transfer portion and that of the core portion were varied. Conditions of the analysis were as follows: the sectional area of the ground electrode (hereinafter, referred to as the "electrode sectional area") was set to 3.5 $mm^2$, and the sectional area of the heat transfer portion was set to 30% of the electrode sectional area. Also, as shown in FIG. 9, the temperature of the atmosphere was set such that, when the distal end position of the heat transfer portion and that of the core portion coincided with the axis of the center electrode (in FIG. 9, the distal end position of the heat transfer portion and that of the core portion are at "0 mm"), the distal end section of the ground electrode had a temperature of 850° C.

Figure 9:
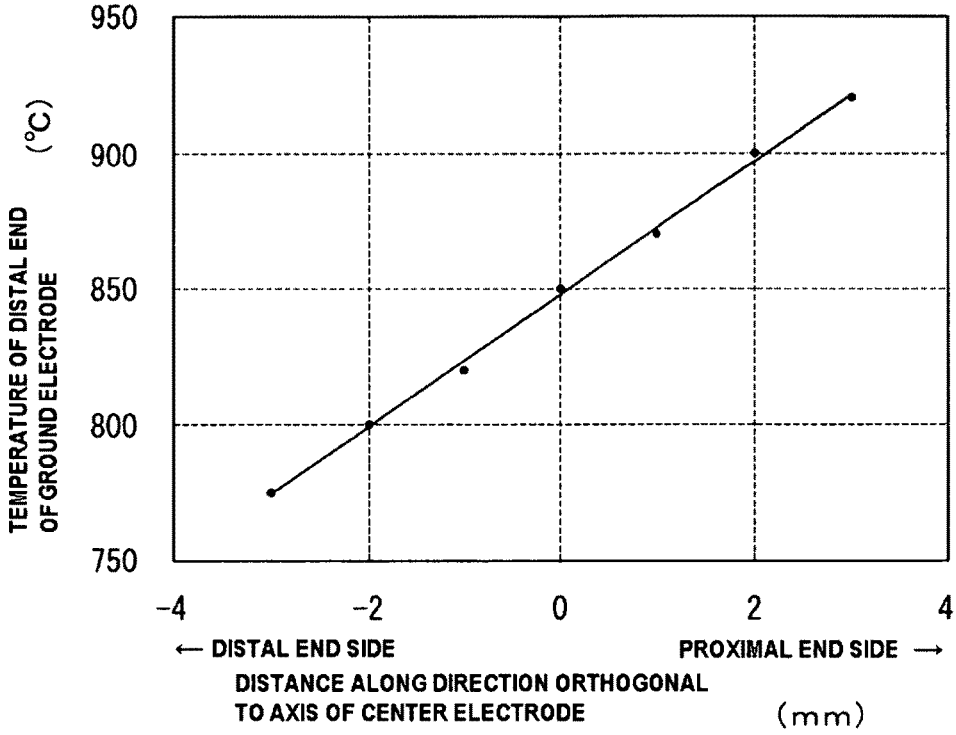
FIG. 9 is a graph showing the temperature of a distal end of a ground electrode of Test Example 1-4.

As a result, as shown in FIG. 9, as compared with the case where the distal end position of the heat transfer portion and that of the core portion coincide with the axis of the center electrode (in FIG. 9, the distal end position of the heat transfer portion and that of the core portion are at "0 mm"), as the distal end position of the heat transfer portion and that of the core portion go beyond the axis of the center electrode toward the distal end of the ground electrode, the temperature of the distal end section drops, and, as the distal end position of the heat transfer portion and that of the core portion go behind the axis of the center electrode toward the proximal end of the ground electrode, the temperature of the distal end section increases.

As understood from the above-mentioned test results of Test Examples 1-1 to 1-4, the ground electrode of a conventional spark plug has the following characteristics. As the distal end position of the heat transfer portion and that of the core portion go toward the distal end of the ground electrode, the heat transfer portion accounts for an increased percentage of the ground electrode. Therefore, the tendency of the thermally expanded heat transfer portion pressing the external layer increases; as a result, the rising of the ground electrode is more apt to occur.

Test Example 1-5

In Test Example 1-5, the amount of rising of a ground electrode was actually measured for a ground electrode having an eccentricity of 0% and a ground electrode having an eccentricity greater than 0%. The ground electrode having an eccentricity greater than 0% is the ground electrode 4 of the spark plug 100 of the first embodiment. The test was conducted under the following conditions: heating and cooling on a desk were repeated 3,000 cycles each consisting of heating by a burner for one minute and cooling for one minute, and heating by a burner was such that the ground electrode had a temperature of 850° C. The test under the test conditions corresponds to a 100 Hr thermal durability test on an engine. The distal end position of the thermal transfer portion and that of the core portion are set to coincide with the axis of the center electrode. Two kinds of electrode sectional areas were employed; specifically, 3.5 $mm^2$ (2.7 mm width× 1.3 mm thickness) and 2.4 $mm^2$ (2.2 mm width×1.1 mm thickness). Two kinds of ground electrodes having such small sectional areas can be applied to spark plugs of small sizes (small diameters) in which the threaded portion 7 of the metallic shell 1 has a screw diameter of M12, M10, or the like. The sectional area of the heat transfer portion was set to 30% of the sectional area of the ground electrode.

Figure 10:
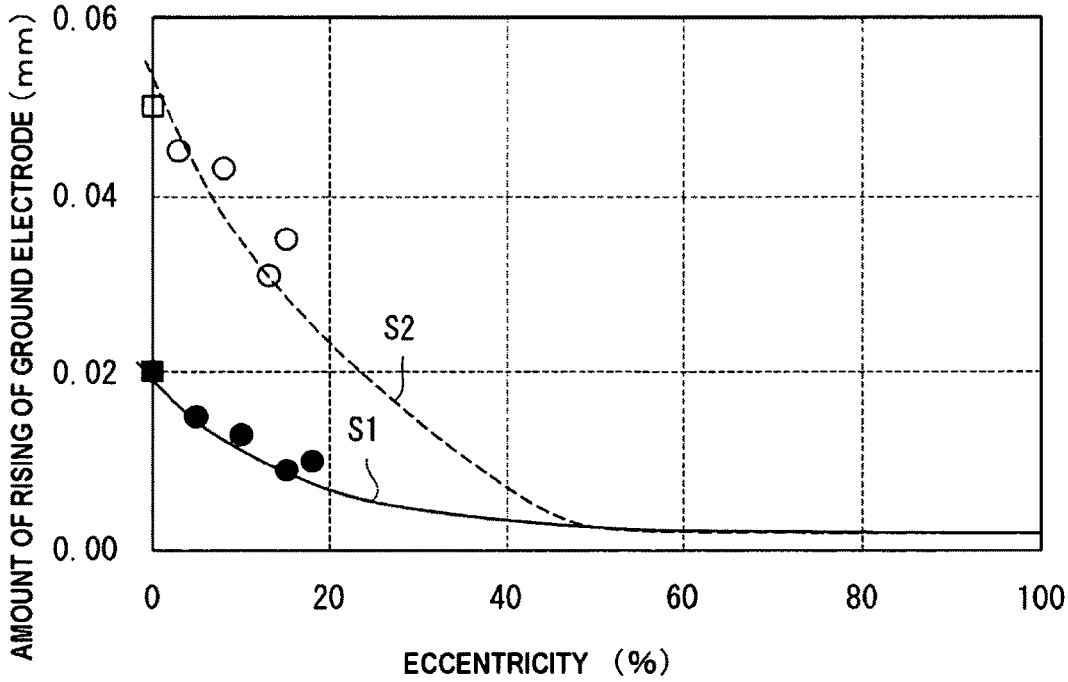
FIG. 10 is a graph showing the relation between the eccentricity and the amount of rising of a ground electrode of Test Example 1-5.

As a result, as shown in FIG. 10, the ground electrode having an electrode sectional area of 3.5 $mm^2$ and an eccentricity of 0% as represented by the black square "■" exhibited an amount of rising of 0.02 mm. The ground electrode having an electrode sectional area of 2.4 $mm^2$ and an eccentricity of 0% as represented by the white square "□" exhibited an amount of rising of 0.05 mm. This indicates that a ground electrode having a small electrode sectional area; i.e., a thin ground electrode is more apt to rise than is a ground electrode having a large electrode sectional area; i.e., a thick ground electrode.

By contrast, the ground electrodes having an electrode sectional area of 3.5 $mm^2$ and an eccentricity greater than 0% as represented by the black circle "○" exhibit rising whose amount is smaller than the amount of rising of the ground electrode represented by the black square "■" by an amount which increases with the eccentricity. The ground electrodes having an electrode sectional area of 2.4 $mm^2$ and an eccentricity greater than 0% as represented by the white circle "○" exhibit rising whose amount is smaller than the amount of rising of the ground electrode represented by the black square "□" by an amount which increases with the eccentricity.

As confirmed from the test results of Test Example 1-5, the spark plug 100 of the first embodiment can reliably restrain rising of the ground electrode 4.

Since the ground electrode of a solid material used in Test Example 1-1 is conventionally known to have an amount of rising of about 0.005 mm, it is presumed that, as the eccentricity increases, the amount of rising of the ground electrodes represented by the black and white circles "●" and "○" reduces to about 0.005 mm and then becomes substantially constant. Thus, the amounts of rising of the ground electrodes represented by the black circles "●" can be approximated by the curve S1. Also, the amounts of rising of the ground electrodes represented by the white circles "○" can be approximated by the curve S2. The curves S1 and S2 indicate that the amount of rising reduces until the eccentricity increases up to 50% and that the amount of rising is substantially constant at an eccentricity of 50% or greater. In the case of the spark plug 100 of the first embodiment having an eccentricity of 50% or greater, a region of the heat transfer portion 42 located on the side opposite the center electrode 3 becomes reliably greater in sectional area than a region of the heat transfer portion 42 located on the side toward the center electrode 3. Also, the core portion 41 projects far into the region of the heat transfer portion 42 located on the side toward the center electrode 3. Thus, in the spark plug 100, the heat transfer portion 42 and the core portion 41 collectively exhibit the above-mentioned action of a bimetal more readily in such a manner as to further increase the degree of bending of the bent section 4B. Therefore, in the spark plug 100, the rising of the ground electrode 4 can be more reliably restrained.

Second Embodiment

A spark plug of the second embodiment differs from the spark plug 100 of the first embodiment in that a high-strength nickel-based alloy (HASTELLOY B) higher in hardness than pure nickel, is used as the first metal for forming the core portion 41. Other structural features are similar to those of the spark plug 100 of the first embodiment. Thus, structural features similar to those of the spark plug 100 of the first embodiment are denoted by like reference numerals, and repeated description thereof is omitted or brief.

In the spark plug 100 of the first embodiment, pure nickel used to form the core portion 41 has a Vickers hardness of Hv of 125, which is higher than the Vickers hardness Hv of the heat transfer portion 42 (Hv 75), but is lower than the Vickers hardness Hv of the external layer 43 (Hv 230).

By contrast, in the spark plug of the second embodiment, the high-strength nickel-based alloy (HASTELLOY B) used to form the core portion 41 has a Vickers hardness Hv of 250, which is higher than the Vickers hardness Hv of the heat transfer portion 42 (Hv 75) and the Vickers hardness Hv of the external layer 43 (Hv 230).

In the thus-configured spark plug of the second embodiment, the reinforcement effect of the core portion 41 can be improved, so that the spark plug can more reliably yield the actions and effects of the present invention.

Test Example 2 for supporting the description of actions and effects of the spark plug of the second embodiment will next be described in detail.

Test Example 2

In Test Example 1-5 described above, the ground electrode having "an eccentricity of 0%, a Vickers hardness Hv of 125 of pure nickel used to form the core portion 41, a Vickers hardness Hv of 75 of the heat transfer portion 42, a Vickers hardness Hv of 230 of the external layer 43, and an electrode sectional area of 2.4 $mm^2$" was actually measured for the amount of rising. The actually measured amount of rising of the ground electrode was 0.05 mm.

By contrast, Test Example 2 used, for test, a ground electrode having "an eccentricity of 0%, a Vickers hardness Hv of 250 of a high-strength nickel-based alloy (HASTELLOY B) used to form the core portion 41, a Vickers hardness Hv of 75 of the heat transfer portion 42, a Vickers hardness Hv of 230 of the external layer 43, and an electrode sectional area of 2.4 $mm^2$ (2.2 mm width×1.1 mm thickness)." The amount of rising of the ground electrode was actually measured. Test conditions are similar to those of Test Example 1-5 described above. Test Example 2 differs from Test Example 1-5 only in that the high-strength nickel-based alloy (HASTELLOY B) higher in hardness than pure nickel is used as the first metal to form the core portion 41.

As a result, the actually measured amount of rising of the ground electrode tested in Test Example 2 was 0.02 mm, indicating that the rising of the ground electrode can be restrained to a greater extent as compared with the case of Test Example 1-5. It can be confirmed from this that, through impartment of high hardness to the core portion 41, the reinforcement effect of the core portion 41 is enhanced, whereby the rising of the ground electrode 4 can be restrained.

It can be confirmed from the test results of Test Example 2 that, in the spark plug of the second embodiment, the effect of restraining the rising of the ground electrode 4 through employment of eccentricity, and the reinforcement effect of the core portion 41 can be synergetically exhibited, whereby the rising of the ground electrode 4 can be more reliably restrained.

Third Embodiment

A spark plug of the third embodiment has the same structure as that of the spark plug 100 of the first embodiment and has a relation expressed by the following expression, where $Z_1$ is section modulus of the external layer 43, $Z_3$ is section modulus of the core portion 41, $Hv_1$ is the Vickers hardness of the external layer 43, $Hv_3$ is the Vickers hardness of the core portion 41, $S_2$ is the sectional area of the heat transfer portion 42, and $\alpha_2$ is the linear thermal expansion coefficient of the heat transfer portion 42.

$$(Z_1 \times Hv_1 + Z_3 \times Hv_3)/S_2 \times \alpha_2 < 1.5 \times 10^7 \qquad \text{Exp. 1}$$

Other structural features are similar to those of the spark plug 100 of the first embodiment. Thus, structural features similar to those of the spark plug 100 of the first embodiment are denoted by like reference numerals, and repeated description thereof is omitted or brief.

"Section modulus" is defined as a value obtained by dividing the geometric moment of inertia about an axis passing through the centroid of the sectional figure of a material by the maximum distance from the axis to the periphery of the sectional figure. Briefly speaking, "section modulus" is a numerical value which depends on the sectional dimensions and shape of a material and indicates the strength of the material and the degree to which the material is hard to break. The greater the numerical value, the higher the rigidity, and the less likely the material is to bend.

The inventors of the present invention have analyzed the results of experiments and analyses performed on conventional spark plugs, the spark plug 100 of the first embodiment, etc., and have empirically found the above-mentioned Expression 1. Through fulfillment of Exp. 1, the spark plug of the third embodiment can reliably yield the actions and effects of the present invention.

The numerator "$(Z_1 \times Hv_1 + Z_3 \times Hv_3)$" in the left term of Exp. 1 is related to a force which is generated in such a manner as to restrain the rising of the ground electrode.

The denominator "$S_2 \times \alpha_2$" in the left term of Exp. 1 is related to a force which is generated in such a manner as to initiate the rising of the ground electrode.

Test Example 3 for supporting the description of actions and effects of the spark plug of the third embodiment will now be described in detail.

Test Example 3

Test Example 3 tested five kinds of ground electrodes; specifically, Test Samples 3-1 to 3-5 shown in Table 1, having an eccentricity of 0% while "the section modulus $Z_1$ of the external layer 43, the section modulus $Z_3$ of the core portion 41, the Vickers hardness $Hv_1$ of the external layer 43, the Vickers hardness $Hv_3$ of the core portion 41, the sectional area $S_2$ of the heat transfer portion 42, and the linear thermal expansion coefficient $\alpha_2$ of the heat transfer portion 42" were varied.

TABLE 1

| | $Z_1$ | $z_3$ | $Hv_1$ | $Hv_3$ | $S_2$ | $\alpha_2$ | Calculated value of left term of Exp. 1 |
|---|---|---|---|---|---|---|---|
| Test Sample 3-1 | $7.01 \times 10^3$ | $4.05 \times 10^{-2}$ | 230 | 125 | 0.69 | $1.65 \times 10^{-5}$ | $1.46 \times 10^7$ |
| Test Sample 3-2 | $1.18 \times 10^0$ | $8.07 \times 10^{-2}$ | ↑ | ↑ | 1.16 | ↑ | $1.47 \times 10^7$ |
| Test Sample 3-3 | $1.54 \times 10^0$ | $1.44 \times 10^{-1}$ | ↑ | ↑ | 1.38 | ↑ | $1.63 \times 10^7$ |
| Test Sample 3-4 | $1.46 \times 10^0$ | $3.46 \times 10^{-1}$ | ↑ | ↑ | 1.29 | ↑ | $1.78 \times 10^7$ |
| Test Sample 3-5 | $1.46 \times 10^0$ | $1.08 \times 10^0$ | ↑ | ↑ | 1.21 | ↑ | $2.36 \times 10^7$ |

An example method of measuring the Vickers hardnesses $Hv_1$ to $Hv_3$ of the external layer 43, the heat transfer portion 42, and the core portion 41, respectively, will be described below. First, the ground electrode 4 is cut along the XI-XI section shown in FIG. 2. The XI-XI section is taken as a plane orthogonal to the axis of the metallic shell 1 and located about 2 mm away from the front end surface of the metallic shell 1. In the thermal stress distribution obtained in Test Example 1-2 (see FIG. 7), it is presumed that a large thermal stress is generated in the vicinity of a weld zone between the metallic shell 1 and the proximal end section 4A of the ground electrode 4, thereby initiating the rising of the ground electrode 4. Therefore, by selecting the XI-XI section located in the vicinity of the weld zone, the Vickers hardnesses $Hv_1$ to $Hv_3$ can be appropriately measured.

Figure 11:
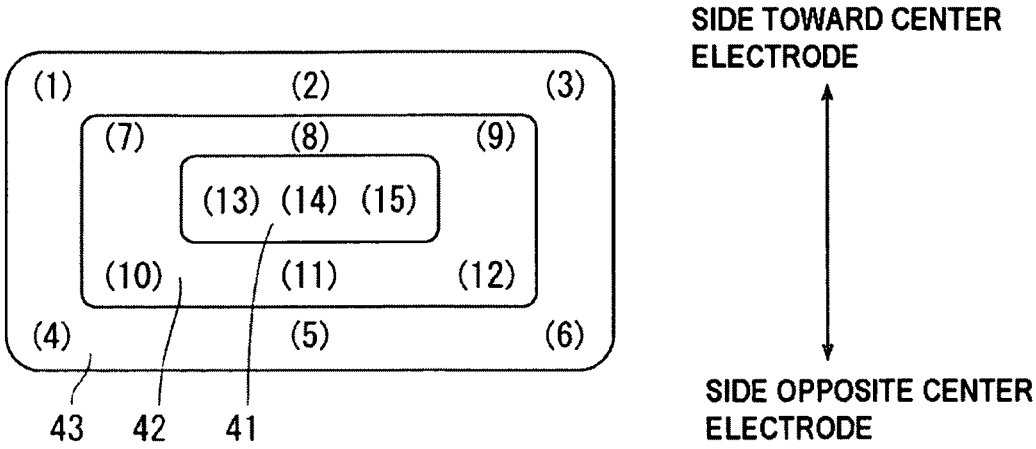
FIG. 11 is an explanatory view showing points of measurement of Vickers hardness on a section, taken along line XI-XI of FIG. 2, of a ground electrode of Test Example 3.

Next, on the XI-XI section of the ground electrode 4 shown in FIG. 11, the Vickers hardness is measured at points of measurement marked with numbers (1) to (15). At this time, preferably, the load of the Vickers hardness tester is set to about 980.7 mN.

Next, the average of the values measured at six points (1) to (6) is obtained, and the obtained average value is taken as the Vickers hardness $Hv_1$ of the external layer 43. Also, the average of the values measured at six points (7) to (12) is obtained, and the obtained average value is taken as the Vickers hardness $Hv_2$ of the heat transfer portion 42. Further, the average of the values measured at three points (13) to (15) is obtained, and the obtained average value is taken as the Vickers hardness $Hv_3$ of the core portion 41.

FIG. 11 shows an example of measurements; specifically, the values of Vickers hardness measured at points (1) to (15), and the Vickers hardnesses $Hv_1$ to $Hv_3$ obtained on the basis of the measured values. The Vickers hardnesses $Hv_1$ to $Hv_3$ for Test Samples 3-1 to 3-5 appearing in Table 1; specifically, "$Hv_1$=230, $Hv_2$=75, $Hv_3$=125," are obtained on the basis of a larger number of measured values.

Table 1 shows the calculated values of the left term of Exp. 1 for Test Samples 3-1 to 3-5. The amount of rising of the ground electrode was actually measured for Test Samples 3-1 to 3-5. The test was conducted under the following conditions: heating and cooling on a desk were repeated for 3,000 cycles each consisting of heating by a burner for one minute and cooling for one minute, and heating by a burner was such that the ground electrode had a temperature of 850° C. The test under the test conditions corresponds to a 100 Hr thermal durability test on an engine.

As a result, Test Samples 3-1 and 3-2 having a calculated value of the left term of Exp. 1 of "$1.46 \times 10^7$" and "$1.47 \times 10^7$," respectively, suffered from the occurrence of rising of the ground electrode and thus were evaluated as "unacceptable." Meanwhile, Test Samples 3-3 to 3-5 having a calculated value of the left term of Exp. 1 of "$1.63 \times 10^7$," "$1.78 \times 10^7$," and "$2.36 \times 10^7$," respectively, were free from the occurrence of rising of the ground electrode and thus were evaluated as "acceptable."

The threshold value of the right term of Exp. 1"$1.5 \times 10^7$" was determined on the basis of the above-mentioned test results. That is, since Test Samples 3-1 and 3-2 which have been evaluated as "unacceptable" and fulfill Exp. 1 have an eccentricity of 0%, it can be confirmed that, through employment of an eccentricity greater than 0%, the effect of restraining the rising of the ground electrode can be reliably yielded.

Therefore, through fulfillment of Exp. 1, the spark plug of the third embodiment can reliably yield the actions and effects of the present invention.

Fourth Embodiment

Figure 12:
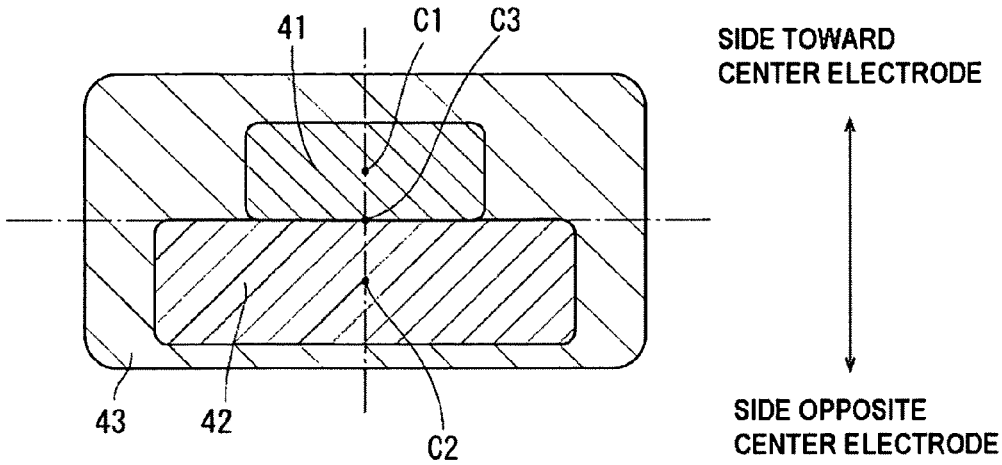
FIG. 12 is a sectional views, similar to that of FIG. 3, of a ground electrode of a spark plug according to a fourth embodiment of the present invention.
Figure 12:
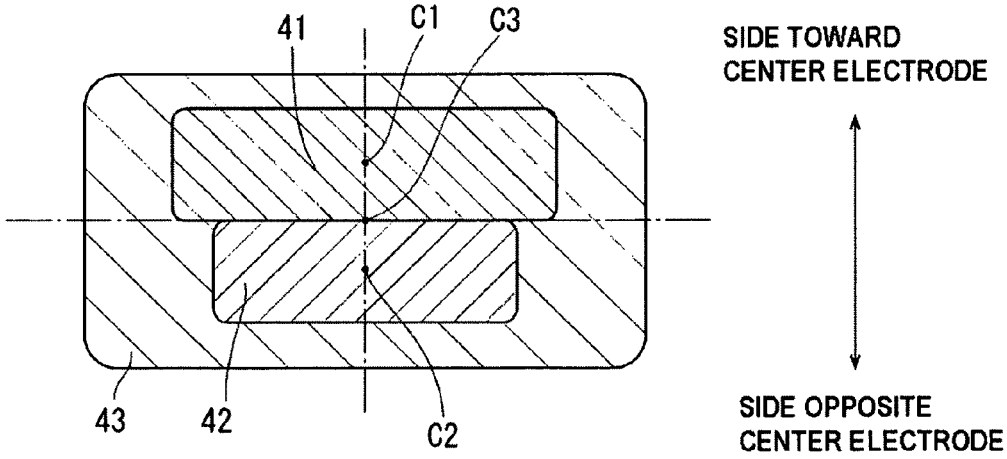

In a spark plug of the fourth embodiment, as shown in FIGS. 12(*a*) and 12(*b*), as viewed on a section of the ground electrode 4 taken orthogonally to a direction along which the ground electrode 4 extends, and located at an intermediate position of the bent section 4B with respect to the direction (section taken along line III-III of FIG. 2), the centroid C2 of the heat transfer portion 42 is located on a side opposite the center electrode 3 with respect to the centroid C3 of the external layer 43. Meanwhile, the centroid C1 of the core portion 41 is located on a side toward the center electrode 3 with respect to the centroid C2 of the heat transfer portion 42 and the centroid C3 of the external layer 43. That is, the core portion 41 is eccentrically positioned toward the center electrode 3, and the heat transfer portion 42 is eccentrically positioned toward the side opposite the center electrode 3. As shown in FIGS. 12(*a*) and 12(*b*), the sectional area of the core portion 41 may be smaller or larger than that of the heat transfer portion 42.

In the thus-configured spark plug of the fourth embodiment, at least at an intermediate portion of the bent section 4B with respect to the direction, a region of the heat transfer portion 42 located on the side opposite the center electrode 3 is reliably greater in sectional area than a region of the heat transfer portion 42 located on the side toward the center electrode 3. Thus, in the spark plug, the heat transfer portion 42 and the core portion 41 collectively function as a bimetal more effectively in such a manner as to increase the degree of bending of the bent section 4B. Therefore, the spark plug can reliably yield the actions and effects of the present invention.

Fifth Embodiment

Figure 13:
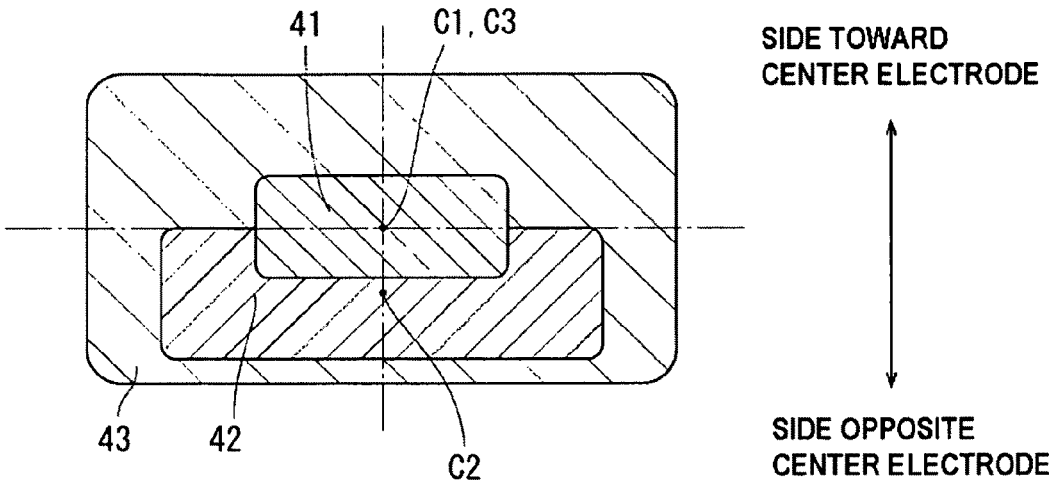
FIG. 13 is a sectional view, similar to that of FIG. 3, of a ground electrode of a spark plug according to a fifth embodiment of the present invention.

In a spark plug of the fifth embodiment, as shown in FIG. 13, the centroid C2 of the heat transfer portion 42 is located on a side opposite the center electrode 3 with respect to the centroid C3 of the external layer 43. Meanwhile, the centroid C1 of the core portion 41 coincides with the centroid C3 of the external layer 43. That is, the core portion 41 is located at the center between a side of the section located on the side toward the center electrode 3 and a side of the section located on the side opposite the center electrode 3, and the heat transfer portion 42 is eccentrically positioned toward the side opposite the center electrode 3.

In the thus-configured spark plug of the fifth embodiment, a region of the heat transfer portion 42 located on the side opposite the center electrode 3 is greater in sectional area than a region of the heat transfer portion 42 located on the side toward the center electrode 3. Thus, in the spark plug, the heat transfer portion 42 and the core portion 41 collectively function as a bimetal more effectively in such a manner as to increase the degree of bending of the bent section 4B. Therefore, the spark plug can reliably yield the actions and effects of the present invention.

Sixth Embodiment

Figure 14:
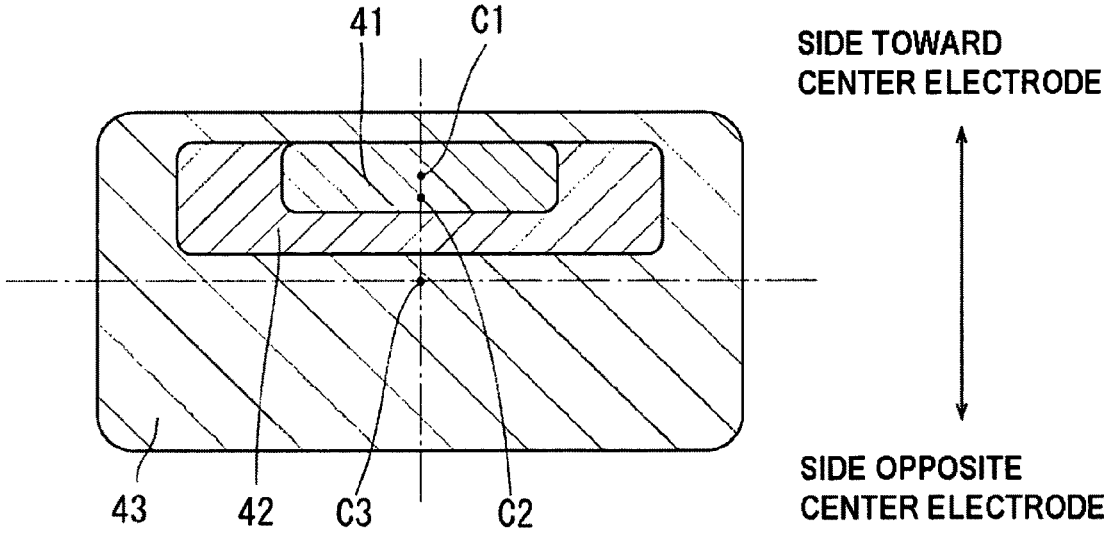
FIG. 14 is a sectional view, similar to that of FIG. 3, of a ground electrode of a spark plug according to a sixth embodiment of the present invention.

In a spark plug of the sixth embodiment, as shown in FIG. 14, the centroid C2 of the heat transfer portion 42 is located on the side toward the center electrode 3 with respect to the centroid C3 of the external layer 43. Meanwhile, the centroid C1 of the core portion 41 is located on the side toward the center electrode 3 with respect to the centroid C2 of the heat transfer portion 42 and the centroid C3 of the external layer 43.

In the thus-configured spark plug of the sixth embodiment, the core portion 41 projects far into a region of the heat transfer portion 42 located on the side toward the center electrode 3. Thus, in the spark plug, the heat transfer portion 42 and the core portion 41 collectively function as a bimetal in such a manner as to increase the degree of bending of the bent section 4B. Therefore, the spark plug can yield the actions and effects of the present invention.

Seventh Embodiment

Figure 15:
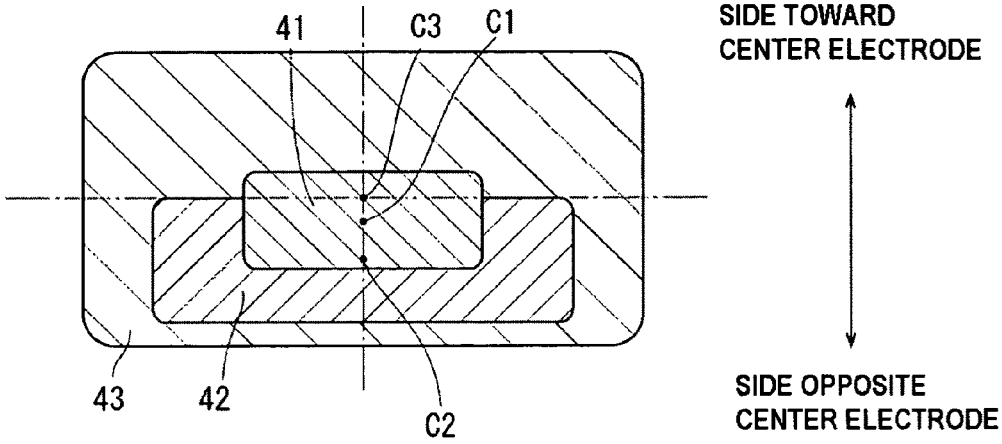
FIG. 15 is a sectional views, similar to that of FIG. 3, of a ground electrode of a spark plug according to a seventh embodiment of the present invention.
Figure 15:
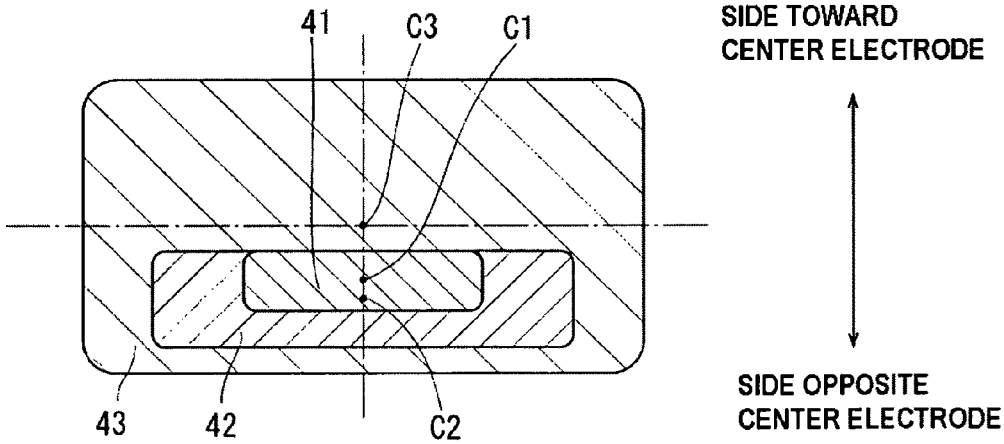

In a spark plug of the seventh embodiment, as shown in FIGS. 15(*a*) and 15(*b*), the centroid C2 of the heat transfer portion 42 is located on the side opposite the center electrode 3 with respect to the centroid C3 of the external layer 43. Meanwhile, the centroid C1 of the core portion 41 is located on the side opposite the center electrode 3 with respect to the centroid C3 of the external layer 43, but is located on the side toward the center electrode 3 with respect to the centroid C2 of the heat transfer portion 42.

In the thus-configured spark plug of the seventh embodiment, the core portion 41 projects far into a region of the heat transfer portion 42 located on the side toward the center electrode 3. Thus, in the spark plug, the heat transfer portion 42 and the core portion 41 collectively function as a bimetal in such a manner as to increase the degree of bending of the bent section 4B. Therefore, the spark plug can yield the actions and effects of the present invention.

Reference Example

Figure 16:
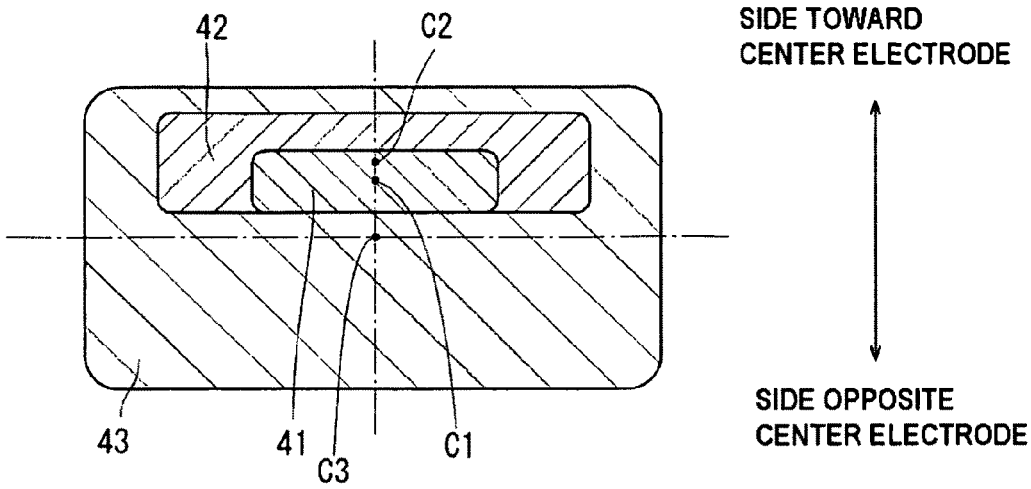
FIG. 16 is a sectional view, similar to that of FIG. 3, of a ground electrode of a spark plug of a reference example.

FIG. 16 shows a spark plug of a reference example. In the spark plug, the centroid C2 of the heat transfer portion 42 is located on the side toward the center electrode 3 with respect to the centroid C3 of the external layer 43. Meanwhile, the centroid C1 of the core portion 41 is located on the side toward the center electrode 3 with respect to the centroid C3 of the external layer 43, but is located on the side opposite the center electrode 3 with respect to the centroid C2 of the heat transfer portion 42.

In the thus-configured spark plug of the reference example, since the centroid C1 of the core portion 41 is not located on the side toward the center electrode 3 with respect to the centroid C2 of the heat transfer portion 42, the heat transfer portion 42 and the core portion 41 collectively function as a bimetal in such a manner as to weaken the degree of bending of the bent section 4B. Therefore, the spark plug encounters difficulty in yielding the actions and effects of the present invention.

An example method of manufacturing the ground electrode 4 for the spark plugs of the first to seventh embodiments described above will be briefly described with reference to FIG. 17.

The method of manufacturing the ground electrode 4 includes a first step for forming a first intermediate member in which a core-portion-forming base element of the third metal is disposed eccentric to a heat-transfer-portion-forming base element of the second metal; a second step for forming a second intermediate member in which the first intermediate member is tightly fitted into a cup-like external-layer-forming base element of the first metal; and a third step for subjecting the second intermediate member to extrusion, thereby forming an extruded article which is thinly extended in the axial direction and has a small sectional area. The steps are described below.

Figure 17:
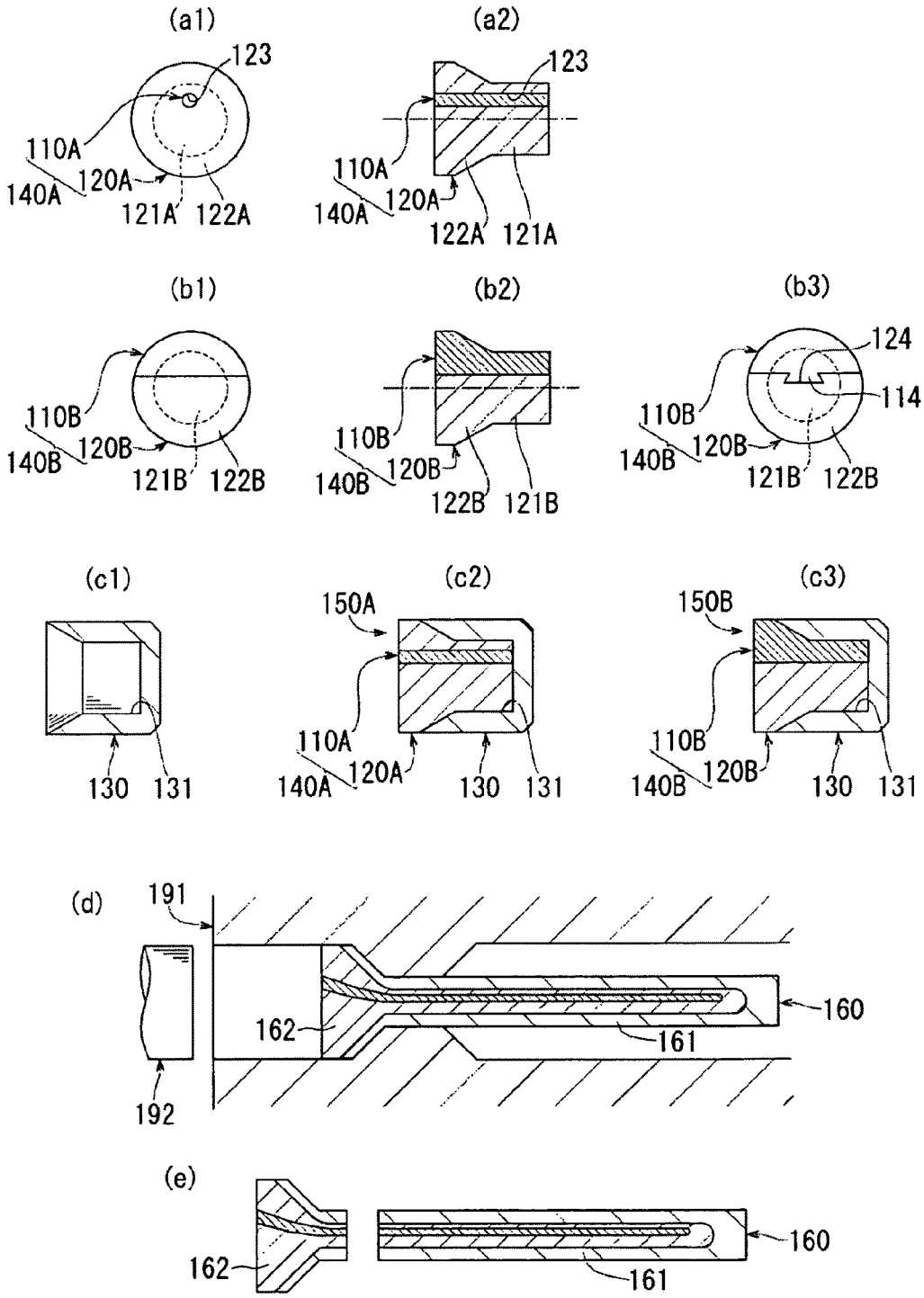
FIG. 17 illustrates explanatory views showing methods of manufacturing the ground electrodes of the spark plugs according to the first to seventh embodiments.

First Step:

In the first step, as shown in FIGS. 17(*a*1) and 17(*a*2), a first intermediate member 140A which has a core-portion-forming base element 110A of the aforementioned third metal and a heat-transfer-portion-forming base element 120A of the aforementioned second metal is formed. FIG. 17(*a*1) is a front view of the first intermediate member 140A. FIG. 17(*a*2) is a sectional view of the first intermediate member 140A.

The third metal is subjected to extrusion so as to form the heat-transfer-portion-forming base element 120A which has a columnar portion 121A and a circular flange portion 122A being coaxial with the columnar portion 121A, formed integrally from one end of the columnar portion 121A, and having a larger outside diameter. The heat-transfer-portion-forming base element 120A has a through hole 123 which extends therethrough and whose axis is in parallel with and eccentric to that of the columnar portion 121A and the flange portion 122A. The core-portion-forming base element 110A is a rod-like element and is inserted into the through hole 123. Thus, in the first intermediate member 140A, the core-portion-forming base element 110A is eccentric to the heat-transfer-portion-forming base element 120A.

FIGS. 17(*b*1) and 17(*b*2) show another example of the first intermediate member; i.e., a first intermediate member 140B. FIG. 17(*b*1) is a front view of the first intermediate member 140B, and FIG. 17(*b*2) is a sectional view of the first intermediate member 140B.

A heat-transfer-portion-forming base element and a core-portion-forming base element which are bars each having a rectangular section are prepared. While they are held in contact with each other, they are subjected to peripheral cutting, thereby forming the first intermediate member 140B having a heat-transfer-portion-forming base element 120B and a core-portion-forming base element 110B as shown in FIGS. 17(*b*1) and 17(*b*2). The first intermediate member 140B has a columnar portion 121B and a circular flange portion 122B being coaxial with the columnar portion 121B, formed integrally from the rear end of the columnar portion 121B, and having a larger outside diameter. In the first intermediate member 140B, the core-portion-forming base element 110B is eccentric to the heat-transfer-portion-forming base element 120B.

As shown in FIG. 17(*b*3), the first intermediate member 140B may be formed as follows. A projection 114 having an inverted trapezoid section is formed on the core-portion-forming base element 110B; a groove 124 to be engaged with the projection 114 is formed in the heat-transfer-portion-forming base element 120B; and the heat-transfer-portion-forming base element 120B and the core-portion-forming base element 110B are joined together through engagement of the projection 114 and the groove 124.

Second Step:

In the second step, as shown in FIG. 17(*c*1), a cup-like external-layer-forming base element 130 of the aforementioned first metal having a circular-hole-like recess 131 is prepared. The first intermediate member 140A shown in FIG. 17(*a*2) is tightly fitted into the recess 131 of the external-layer-forming base element 130, thereby forming a second intermediate member 150A shown in FIG. 17(*c*2). Alternatively, the first intermediate member 140B shown in FIG. 17(*b*2) may be tightly fitted into the recess 131 of the external-layer-forming base element 130, thereby forming a second intermediate member 150B shown in FIG. 17(*c*3).

Third Step:

In the third step, as shown in FIG. 17(*d*), the second intermediate member 150A is subjected to extrusion. Specifically, the second intermediate member 150A is inserted from its leading end into a die 191 having a rectangular die hole by use of a punch 192. As a result, there is formed an extruded article 160 which has a rectangular prism portion 161 having a rectangular section and a columnar portion 162 formed integrally from the rear end of the rectangular prism portion 161 and having a larger outside diameter. For example, the extruded article 160 has a cross section as shown in FIG. 3. Although unillustrated, similarly, through subjection of the second intermediate member 150B to extrusion, an extruded article is formed. In this case, for example, the extruded article has a cross section as shown in FIG. 12.

Next, as shown in FIG. 17(*e*), the extruded article 160 is cut at a position of joint to the metallic shell 1, thereby removing the columnar portion 162 from the rectangular prism portion 161 having an appropriate length. The isolated rectangular prism portion 161 is annealed and is then fixed to the metallic shell 1 while being bent, thereby completing the ground electrode 4.

While the present invention has been described with reference to the embodiments, the present invention is not limited thereto, but may be modified as appropriate without departing from the spirit of the invention.

The present invention can be applied to spark plugs.

DESCRIPTION OF REFERENCE NUMERALS

| Description of Reference Numerals | |
|---|---|
| 1: | metallic shell |
| 3: | center electrode |
| 4: | ground electrode |
| 4A: | proximal end section |
| 4B: | bent section |
| 4C: | distal end section |
| 41: | core portion |
| 42: | heat transfer portion |
| 43: | external layer |
| 100: | spark plug |
| g: | spark discharge gap |
| C1: | centroid of core portion |
| C2: | centroid of heat transfer portion |

Having described the invention, the following is claimed:

1. A spark plug including a ground electrode having a proximal end section fixed to a metallic shell, a bent section formed integral with the proximal end section, and a distal end section formed integral with the bent section and adapted to form a spark discharge gap g in cooperation with a center electrode and in which the ground electrode comprises:

a core portion extending from the proximal end section toward the distal end section via the bent section, a heat transfer portion extending from the proximal end section toward the distal end section via the bent section, and an external layer located externally of the core portion and the heat transfer portion and extending from the proximal end section to the distal end section via the bent section, wherein the external layer is formed from a first metal having heat resistance and corrosion resistance, the heat transfer portion is formed from a second metal higher in thermal conductivity than the first metal, the core portion is formed from a third metal higher in hardness than the second metal, and the second metal is higher in linear thermal expansion coefficient than the first metal and the third metal, wherein, as viewed on a section of the ground electrode taken orthogonally to a direction along which the ground electrode extends, at least at an intermediate position of the bent section with respect to the direction, a center of the core portion is offset toward the center electrode from a center of the heat transfer portion.

2. A spark plug according to claim 1 having at least one of a configuration in which, as viewed on a section of the ground electrode taken orthogonally to a direction along which the ground electrode extends, at least at an intermediate position of the bent section with respect to the direction, the core portion is eccentrically positioned toward the center electrode and a configuration in which, as viewed on a section of the ground electrode taken orthogonally to a direction along which the ground electrode extends, at least at an intermediate position of the bent section with respect to the direction, the heat transfer portion is eccentrically positioned toward a side opposite the center electrode.

3. A spark plug according to claim 2, wherein, as viewed on a section of the ground electrode taken orthogonally to a direction along which the ground electrode extends, at least at an intermediate position of the bent section with respect to the direction, the core portion is located at a center between a side of the section located on a side toward the center electrode and a side of the section located on a side opposite the center electrode, and the heat transfer portion is eccentrically positioned toward the side opposite the center electrode.

4. A spark plug according to claim 2, wherein, as viewed on a section of the ground electrode taken orthogonally to a direction along which the ground electrode extends, at least at an intermediate position of the bent section with respect to the direction, the core portion is eccentrically positioned toward the center electrode, and the heat transfer portion is eccentrically positioned toward the side opposite the center electrode.

5. A spark plug according to claim 2, wherein, as viewed on a section of the ground electrode taken orthogonally to a direction along which the ground electrode extends, at least at an intermediate position of the bent section with respect to the direction, the heat transfer portion is located at a center between a side of the section located on a side toward the center electrode and a side of the section located on a side opposite the center electrode, and the core portion is eccentrically positioned toward the center electrode.

6. A spark plug according to claim 5, wherein, as viewed on a section of the ground electrode taken orthogonally to a direction along which the ground electrode extends, when eccentricity is taken as 0% for a state in which the center of the heat transfer portion and the center of the core portion coincide, and eccentricity is taken as 100% for a state in which the core portion is in contact with the external layer, the eccentricity of the core portion is 50% or greater.

7. A spark plug according to claim 5 having a relation $(Z_1 \times Hv_1 + Z_3 \times Hv_3)/S_2 \times \alpha_2 < 1.5 \times 10^7$, wherein $Z_1$ is section modulus of the external layer, $Z_3$ is section modulus of the core portion, $Hv_1$ is Vickers hardness of the first metal, $Hv_3$ is Vickers hardness of the third metal, $S_2$ is sectional area of the heat transfer portion, and $\alpha_2$ is linear thermal expansion coefficient of the second metal.

8. A spark plug according to claim 1, wherein hardness of the third metal is higher than that of the first metal, and hardness of the first metal is higher than that of the second metal.

9. A spark plug according to claim 1, wherein, as viewed on a section of the ground electrode taken orthogonally to a direction along which the ground electrode extends, the positional relations are established over the entire region of the bent section along the direction.

* * * * *